US005615001A

United States Patent [19]

Kawashima et al.

[11] Patent Number: 5,615,001

[45] Date of Patent: Mar. 25, 1997

[54] MULTICOLOR IMAGE FORMING APPARATUS

[75] Inventors: Masato Kawashima; Hideyuki Shimobuchi; Hiroyuki Okitsu; Masato Matsuzuki; Hiroaki Yoshida, all of Kawasaki; Michihiro Fujii, Katou-gun; Yukinari Okawa, Kawasaki; Masaru Iida, Kawasaki; Katsuyasu Ito, Kawasaki; Yukihide Toda, Kawasaki; Seiji Nagai, Katou-gun, all of Japan

[73] Assignee: Fujitsu Limited, Kawasaki, Japan

[21] Appl. No.: 496,401

[22] Filed: Jun. 29, 1995

[30] Foreign Application Priority Data

Jun. 30, 1994 [JP] Japan ..... 6-149441

[51] Int. Cl.[6] ..... G03G 15/01

[52] U.S. Cl. ..... 399/226; 399/112

[58] Field of Search ..... 355/200, 210, 355/203, 204, 208, 308, 309, 318, 319, 326 R, 327, 260

[56] References Cited

U.S. PATENT DOCUMENTS

| | | | |
|---|---|---|---|
| 4,888,620 | 12/1989 | Fujino et al. . | |
| 4,928,128 | 5/1990 | Stemmle | 355/319 X |
| 4,939,541 | 7/1990 | Sugiura | 355/210 X |
| 4,990,966 | 2/1991 | Sindo . | |
| 5,014,094 | 5/1991 | Amitani et al. . | |
| 5,030,987 | 7/1991 | Kato et al. | 355/318 X |
| 5,117,265 | 5/1992 | Matsui et al. | 355/319 X |
| 5,266,998 | 11/1993 | Lee | 355/210 |
| 5,331,386 | 7/1994 | Mizubata et al. | 355/319 |
| 5,386,286 | 1/1995 | Kinouchi et al. | 355/326 R |
| 5,448,343 | 9/1995 | Nakamichi et al. | 355/309 X |
| 5,453,822 | 9/1995 | Anzai et al. . | |
| 5,469,248 | 11/1995 | Fujiwara et al. | 355/326 R |

FOREIGN PATENT DOCUMENTS

| | | |
|---|---|---|
| 0602661 | 6/1994 | European Pat. Off. . |
| 4316287 | 11/1993 | Germany . |
| 58-181058 | 10/1983 | Japan . |
| 59-149380 | 8/1984 | Japan . |
| 61-228461 | 10/1986 | Japan . |
| 62-92978 | 4/1987 | Japan . |
| 63-8659 | 1/1988 | Japan . |
| 1-107280 | 4/1989 | Japan . |
| 1-199022 | 8/1989 | Japan . |
| 3-33760 | 2/1991 | Japan . |
| 3-174546 | 7/1991 | Japan . |
| 3-288173 | 12/1991 | Japan . |
| 4-98266 | 3/1992 | Japan . |
| 4-157478 | 5/1992 | Japan . |
| 5-19641 | 1/1993 | Japan . |
| 5-35008 | 2/1993 | Japan . |
| WO92/08169 | 5/1992 | WIPO . |
| WO92/14192 | 8/1992 | WIPO . |

OTHER PUBLICATIONS

Patent Abstract of Japan, vol. 12, No. 203 (P–715) dated Jun. 11, 1988, titled Image Forming Device.

European Search Report dated Oct. 19, 1995, Ref. No.: HL 52873/CIV citing above listed references.

*Primary Examiner*—Sandra L. Brase

*Attorney, Agent, or Firm*—Armstrong, Westerman, Hattori, McLeland & Naughton

[57] ABSTRACT

A plurality of electrostatic recording units are arranged in series along a path for moving a recording sheet of paper, and charged toner images having different colors are formed on the sheet of paper travelled through the path. A paper feeder unit is arranged beneath a paper introduction side of the paper moving path. The sheet of paper carrying the toner image formed thereon is ejected from a paper ejection side of the paper moving path, and is sent to a fixer in which the toner image is fixed on the sheet of paper. The sheet of paper carrying the toner image fixed thereon is sent to a paper receiver tray positioned above the fixer.

26 Claims, 24 Drawing Sheets

102
114
96
114
150
153
150
150
150

MULTICOLOR IMAGE FORMING APPARATUS

BACKGROUND OF THE INVENTION

1) Field of the Invention

The present invention relates to an image forming apparatus having an electrostatic recording unit, and more particularly to a multicolor image forming apparatus performing multicolor recording by arranging a plurality of electrostatic recording units in series.

2) Description of the Related Art

In general, in an electrostatic recording unit utilizing the electrostatic recording technique, an electrostatic latent image is written on an electrostatic latent image carrying body such as a photosensitive body, dielectric body, etc.; the electrostatic latent image is electrostatically developed as a charged toner image by a developer, i.e., a so-called toner; the charged toner image is electrostatically transferred to a recording medium such as a recording sheet of paper; and then the transferred toner image is fixed on the recording medium by heat, pressure, light, etc.

As a multicolor image forming apparatus utilizing the electrostatic recording technique as mentioned above, a single-drum type of multicolor recording apparatus is known. This multicolor recording apparatus comprises a single electrostatic image carrying body, i.e., a photosensitive drum, and a plurality of developing devices using different developers composed of different colors, respectively, and arranged between an electrostatic image writing location, at which an electrostatic latent image is written on the photosensitive drum, and a transfer charger. For example, a multicolor recording apparatus for a full-color recording is provided with four developing devices, which use a yellow developer composed of yellow toner, a cyan developer composed of cyan toner, a magenta developer composed of magenta toner, and a black developer composed of black toner, respectively. An electrostatic latent image is first formed on the photosensitive drum on the basis of yellow image data, and is developed as a yellow toner image by the yellow toner. Then, the yellow toner image is transferred from the photosensitive drum to a recording sheet of paper, and is fixed on the sheet of paper. Subsequently, an electrostatic latent image is formed on the photosensitive drum on the basis of cyan image data, and is developed as a cyan toner image by the cyan toner, and then the cyan toner image is transferred to and fixed on the sheet of paper carrying the yellow toner image previously fixed thereto. A similar process is carried out also for the magenta image data and the black image data. Thus, the toner images of four colors are superimposed on the sheet of paper, whereby an image recording of full color is achieved. The single-drum type of multicolor recording apparatus has an advantage that the whole structure thereof can be made relatively compact, but toner images having different colors must be successively formed by a single photosensitive drum, and therefore there arises a problem in that high speed recording cannot be achieved.

Also, as a multicolor recording apparatus utilizing electrostatic recording techniques, a multi-drum type of multicolor recording apparatus is known, which comprises four electrostatic recording units aligned with each other along path for moving a recording sheet of paper. The respective electrostatic recording units includes developing devices which use a developer composed of yellow toner, a developer composed of cyan toner, a developer composed of magenta toner, and a developer composed of black toner. While a recording sheet of paper is moved along the path, a yellow toner image, a cyan toner image, a magenta toner image and a black toner image are sequentially formed on the sheet of paper by the four electrostatic recording devices, whereby a full-color image is obtained on the sheet of paper.

Although the multi-drum type multicolor recording apparatus as mentioned above is advantageous in that a high-speed multicolor recording can be carried out, it has a major disadvantage in that the construction thereof is large due to the alignment of the electrostatic recording units in series. Also, the apparatus is provided with a paper feeder unit for holding a stack of paper sheets to be recorded, and a paper receiver unit for accommodating a stack of recorded paper sheets, and these units are usually assembled in a housing of the apparatus so as to extend therefrom. Accordingly, the area occupied by the whole structure of the apparatus, for the installation thereof, that is, an area occupied by a projection of the whole structure of the apparatus onto the floor becomes larger. Further, since various constituent elements such as an electrical power source unit, an electronic controller unit, etc. are provided within the housing of the apparatus, it is required to reduce the overall structure of the apparatus in size by arranging these constituent elements in a compact size as a whole. Particularly, where the apparatus is constituted such that two-sided recording is performed on a recording sheet of paper, a paper bypass passageway must be provided for returning the sheet of paper, on which one-sided recording is made, to the path along which the electrostatic recording units are aligned in series, for the two-sided recording. In this case, the paper bypass passageway should be arranged in the apparatus housing in a compact size together with the above-mentioned constituent elements. In addition, in the multi-color image forming apparatus constituted in a compact size, ease of maintenance is liable to be sacrificed due to the compact size thereof, and therefore in the multi-color image forming apparatus, a reduction of size considering the ease of maintenance thereof is demanded.

SUMMARY OF THE INVENTION

Accordingly, it is a principal object of the present invention to provide a multicolor image forming apparatus comprising a plurality of electrostatic recording units utilizing the electrostatic recording technique and aligned with each other in series, which is constituted such that the required installation or projection area thereof can be reduced as much as possible by making an entire construction thereof compact in size.

Another object of the present invention is to provide a multicolor image forming apparatus comprising a plurality of electrostatic recording units utilizing the electrostatic recording technique and aligned with each other in series, wherein the ease of maintenance thereof is taken into account together with a reduction in size of the overall construction thereof.

In accordance with an aspect of the present invention, there is provided a multicolor image forming apparatus comprising: a recording medium moving means for providing a path for moving a recording medium, the recording medium moving means having a recording medium introduction side and a recording medium ejection side; a recording medium feeding means arranged beneath the recording medium introduction side of the recording medium moving means; a first recording medium guiding means for sending the recording medium fed from the recording medium feeding means upwardly and for guiding the same to the recording medium introduction side of the recording medium moving means; at least two electrostatic recording units which are arranged in series along the path for moving the recording medium so as to record electrically charged toner images of different colors on the recording medium sent along the path for moving the recording medium; a fixing means which is arranged on the recording medium ejection side of the recording medium moving means for fixing the charged toner image on the recording medium carrying the electrically charged toner image; a second recording medium guiding means for guiding upward the recording medium passed through the fixing means; and a recording medium receiving means which is arranged above the fixing means for accommodating the recording medium sent by the second recording medium guiding means. In this apparatus, a power source means and a control means of the apparatus may be provided beneath the recording medium moving means. Also, the apparatus may further comprise a recording medium bypass passageway means for returning the recording medium from the second recording medium guiding means to the first recording medium guiding means so as to perform a two-sided recording on the recording medium, the recording medium bypass passageway means being extended just below the recording medium moving means and above an upper side of the recording medium feeding means.

Each of the electrostatic recording units may include an electrostatic latent image carrying body; an electrical charging means for giving an electrical charge to an area of this electrostatic latent image carrying body; an optical writing means for optically writing the electrostatic latent image in the charged area of the electrostatic latent image carrying body; a developing means for developing the electrostatic latent image on the electrostatic latent image carrying body as a charged toner image; a transfer means for electrostatically transferring the charged toner image developed by the developing means from the electrostatic latent image carrying body to the recording medium to be moved by the recording medium moving means; and a cleaning means for cleaning a residual toner of the electrostatic latent image carrying body therefrom. The apparatus may further comprise a main frame, and a first sub-frame which is movable between a pushed-in position in the main frame and a pulled-out position drawn out of the main frame, and the developing means is detachably mounted on the first sub-frame. Also, the electrostatic latent image carrying body, the electrically charging means, and the cleaning means may be detachably mounted on the first sub-frame as a unit or individually. The apparatus may further comprise a second sub-frame which is movable between a pushed-in position in the main frame and a pulled-out position drawn out of the main frame, and which is arranged beneath the first sub-frame, and the recording medium moving means is mounted on the second sub-frame. In this arrangement, the electrostatic latent image carrying body may have a driven coupling provided at one shaft end thereof, and the driven coupling is engaged with a drive coupling provided in the main frame when the first sub-frame is moved to the pushed-in position thereof. Also, the second sub-frame may have a positioning coupling provided therein, and the positioning coupling is engaged with the other shaft end of the electrostatic latent image carrying body when the second sub-frame is moved to the pushed-in position thereof. Also, the transfer means may be installed in the recording medium moving means detachably mounted on the second sub-frame. Further, the recording medium moving means may include a driven roller and a drive roller which are respectively provided on the recording medium introduction side and the recording medium ejection side thereof, and an endless belt engaged with the rollers, and the two end portions of both shafts of the driven roller and the drive roller are supported detachably by the second sub-frame.

Preferably, the drive shaft of the drive roller is detachably supported by the second sub-frame via a bearing provided on the two end portions thereof, and the drive shaft has a driven coupling provided at one end portion thereof, and the driven coupling is engaged with the drive coupling provided in the main frame when the second sub-frame is moved to the pushed-in position thereof.

When the recording medium bypass passageway means is provided between the first recording medium guiding means and the second recording medium guiding means so that the two-sided recording can be made on the recording medium, preferably, the recording medium bypass passageway means has a plurality of recording medium guide roller assemblies each of which forms a part of the recording medium bypass passageway means. Each of the recording medium guide roller assemblies includes a pair of shaft elements, and roller elements mounted on each of the shaft elements, and one of the of shaft elements is rotatably supported by a first guide plate, attached to a bottom portion of the second sub-frame. The other shaft element is rotatably supported by a second guide plate pivotably attached to the first guide plate, and the second guide plate is locked to the first guide plate so as to maintain a position where it is parallel to the first guide plate.

Furthermore, the apparatus may comprise an additional recording feeding means optionally associated with the first recording medium guiding means for feeding a recording medium from the additional recording medium feeding means to the first recording medium guiding means, and an additional recording medium receiving means optionally associated with the second recording medium guiding means for accommodating the recording medium sent by the second recording medium guiding means. In this case, the second recording medium guiding means has a recording medium guide path branched therefrom, and a recording medium switching means provided at a location at which the recording medium guide path is branched from the second recording medium guiding means.

In accordance with another aspect of the present invention, there is provided a multicolor image forming apparatus comprising: a recording medium moving means for providing a path for moving a recording medium; a first electrostatic recording unit arranged on the path for moving the recording medium so as to record an electrically charged toner image on the recording medium on the basis of a first color image data, the first electrostatic recording unit including an electrostatic latent image carrying body on which an electrostatic latent image is formed, and a developing means for developing the electrostatic latent image on the electrostatic latent image carrying body with a first color toner as a charged toner image; a second electrostatic recording unit arranged and aligned with the first electrostatic recording unit along the path for moving the recording medium so as to record an electrically charged toner image on the recording medium on the basis of a second color image data, the second electrostatic recording unit including an electrostatic latent image carrying body on which an electrostatic latent image is formed, and a developing means for developing the electrostatic latent image on the electrostatic latent image carrying body with a second color toner as a charged toner image; a first determination means for determinating whether or not the first color image data is included in a whole image data to be recorded; a first stopping means for stopping the electrostatic latent image carrying body and the developing means of the first electrostatic recording unit when it is determined by the first determination means that the first color image data is not included in the whole image data to be recorded; a second determination means for determinating whether or not the second color image data is included in the whole image data to be recorded; and a second stopping means for stopping the electrostatic latent image carrying body and the developing means of the first electrostatic recording unit when it is determined by the second determination means that the second color image data is not included in the whole image data to be recorded.

BRIEF DESCRIPTION OF THE DRAWINGS

Other objects and advantages of the present invention will be better understood from the following description, with reference to the accompanying drawings in which.

DESCRIPTION OF THE PREFERRED EMBODIMENTS

Figure 1:
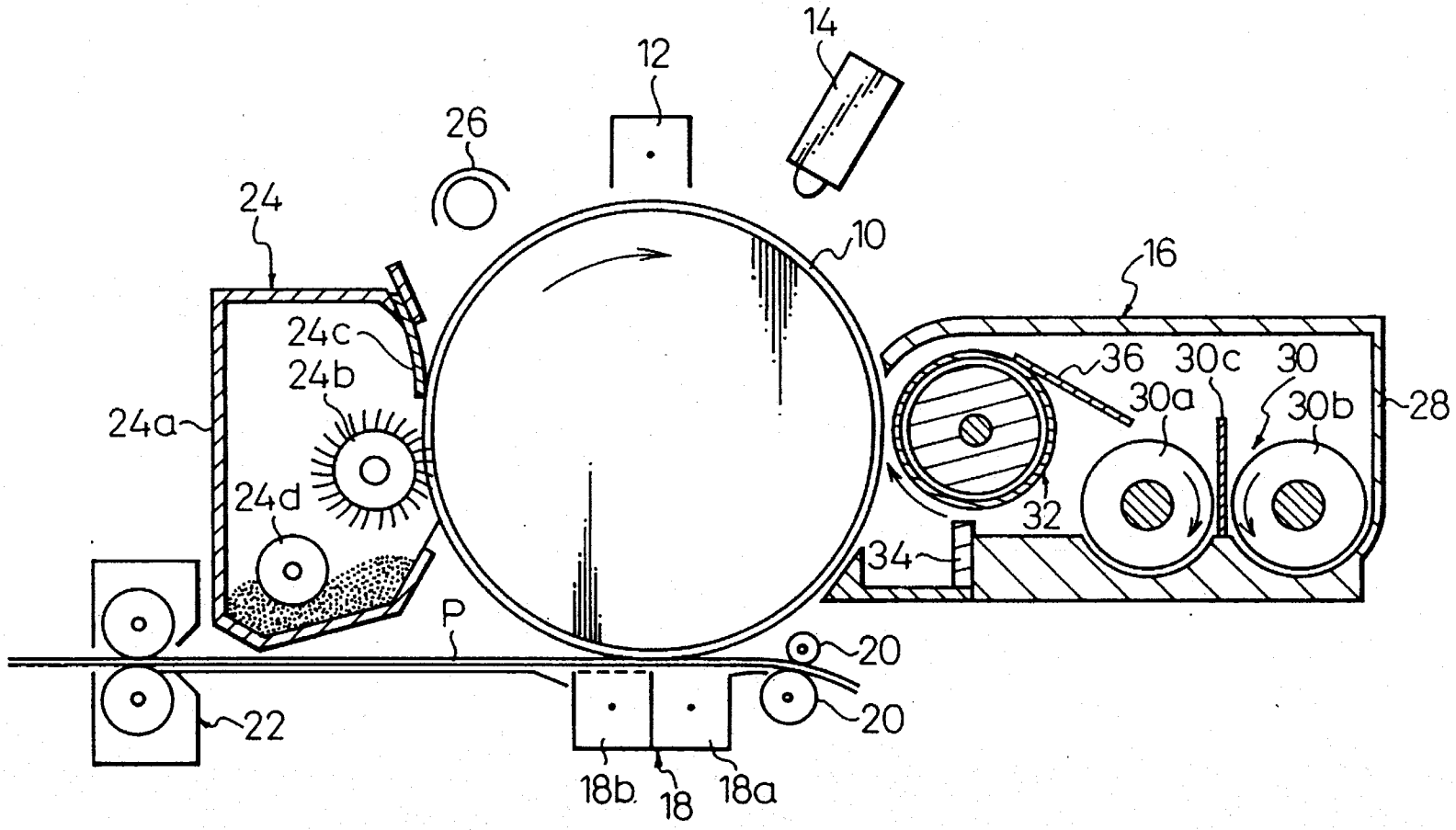
Fig. 1 PRIOR ART
FIG. 1 is a schematic view showing an example of a representative electrostatic recording unit which may be used in a multicolor image forming apparatus according to the present invention.

FIG. 1 schematically shows a representative electrostatic recording unit adopting an electrophotographic system illustrated, which unit may be utilized to constitute a multicolor image forming apparatus according to the present invention. The electrostatic recording unit comprises a photosensitive drum 10 as an electrostatic latent image carrying body, and the drum 10 is rotated in a direction indicated by an arrow in FIG. 1, during an operation thereof.

The photosensitive drum 10 is uniformly charged by a precharger 12, and an electrostatic latent image is written at the electrically-charged area by an optical writing means 14. The precharger 12 may be constituted as, for example, a corona charger or a scorotron charger, but, as another precharger, also an electrically conductive roller charger or an electrically conductive brush charger may be mentioned. The optical writing means 14 may comprises a laser beam scanner, an LED (light emission diode) array, a liquid crystal shutter array or the like. The electrostatic latent image written on the photosensitive drum 10 is electrostatically developed as an charged toner image by the developing device 16, and the charged toner image is electrostatically transferred to a recording medium, such as a sheet of paper P, by a transfer device 18.

The sheet of paper P is fed from a paper feeder unit (not shown); the sheet of paper P is then stopped at a position of a pair of register rollers 20 and made to stand by; and subsequently the sheet of paper P is sent between the photosensitive drum 10 and the transfer device 18 by the pair of register rollers 20 at a given timing in accordance with the writing of the electrostatic latent image to the photosensitive drum 10, whereby the charged toner image is transferred to the sheet of paper P at a predetermined position. In the illustrated example, the transfer device 18 includes a transfer charger 18*a*, and an AC charge eliminator 18*b* associated therewith and disposed adjacent thereto. The transfer charger 18*a*, which may be a corona discharger, is subjected to a DC voltage to give the sheet of paper P an electric charge having a polarity opposite to that of the electric charge of the developed toner image, whereby the transfer of the toner image from the photosensitive drum 10 to the sheet of paper p can be carried out. The AC charge eliminator 18*b*, which also may be a corona discharger, is subjected to an AC voltage to partially eliminate the electric charge of the sheet of paper carrying the transferred toner image, whereby an electrostatic attraction acting between the sheet of paper and the photosensitive drum 10 can be weakened for an effective separation of the sheet of paper from the drum 10.

Then, the sheet of paper P subjected to the transfer process is fed to a fixing unit 22, and the transferred toner image is fixed on the sheet of paper P thereat. In the illustrated example, the fixing unit 22 is constituted as a heat fixer comprising a heat roller 22*a* and a back-up roller 22*b*, and thus the transferred toner image is thermally fused and fixed on the sheet of paper P when passing between those rollers.

In the toner image transferring process, a small amount of toner is left on the surface of the photosensitive drum 10 as a residual toner not transferred to the sheet of paper P, and the residual toner is removed from the surface of the drum 10 by a toner cleaning device 24. In the case where the electrostatic recording unit is used for high speed recording, it is required to smoothly and reliably remove the residual toner from the surface of the photosensitive drum 10, because the amount of the residual toner to be treated becomes large due to the fact that the recording must be carried out on a large number of sheets of paper in high speed recording.

For this reason, in a high speed electrostatic recording unit, a cleaning device 24 of the type as shown in FIG. 1 is generally used. In particular, the cleaning device 24 is provided with a toner collecting vessel 24*a* having an opening for receiving a part of the photosensitive drum 10, a fur brush 24*b* provided in the toner collecting vessel 24*a* close to the opening thereof, a toner scraping blade 24*c* provided along an upper edge of the opening of the toner collecting vessel 24*a*, and a screw conveyor 24*d* provided at a bottom of the toner collecting vessel 24*a*. Of course, the fur brush 26*b* acts so as to brush off the residual toner from the surface of the drum 10, and the scraping blade 24*c* acts so as to scrape the residual toner which cannot be brushed off by the fur brush 24*b*. The residual toner removed by the fur brush 24*b* and the scraping blade 24*c* is collected in the toner collecting vessel 24*a*, but the collected toner is conveyed from the toner collecting vessel 24*a* to a given location by the screw conveyor 248. The surface of the photosensitive drum 10 cleaned by the cleaning device 24 is illuminated by a discharging lamp 26, to thereby remove the remaining electrical charge from the illuminated drum surface.

As the developer used in the above-mentioned developing process, a two-component developer composed of a toner component (fine particles of colored resin) and a magnetic component (fine magnetic carriers) is well known. In general, the two-component developer is widely used in multicolor recording. The developing device using the two-component developer includes a container 28 for holding the two-component developer, an agitator 30 for agitating the two-component developer to cause the toner component and the magnetic carrier component to be subjected to triboelectrification, and a magnet roller or developing roller 32 for forming a magnetic brush therearound by magnetically attracting a part of the magnetic carrier component. The developing roller 32 is partially exposed from the developer container 28 and faces the photosensitive drum 10. The toner component is electrostatically attracted to the magnetic brush formed around the developing roller 32, and is brought to a facing zone or developing zone between the developing roller and the photosensitive drum due to the rotation of the developing roller 32, whereby development of an electrostatic latent image can be carried out. Since the density of a toner image obtained by developing an electrostatic latent image is dependent on a quantity of toner brought to the developing zone, the height of the magnetic brush is regulated by a doctor blade 34 to ensure evenness of the density of development. The developer which has passed through the developing zone, i.e., the developer having a reduced toner component, is scraped off the developing roller 32 by a scraper blade 36, and is then returned to the agitator 30.

Since the toner component is consumed continuously during the developing process, the two-component developer must be properly replenished with a toner component, to thereby maintain the quality of the developed toner images and, therefore the recorded toner images, constant. Also, a uniform distribution of the toner component in the magnetic carrier component is an important factor in the quality of the recorded toner image, as well as sufficient triboelectrification between the toner component and the magnetic carrier component. Further, in a high-speed recording, consumption of the developer in the developing process necessarily becomes larger, and thus the developer must be quickly and efficiently agitated. For this reason, in general, the agitator 30 is constituted as a circulation-type agitator as illustrated. In particular, the agitator 30 comprises a pair of screw conveyors 30*a* and 30*b*, and a partition plate 30*c* disposed therebetween, and the pair of screw conveyors 30*a* and 30*ba* is disposed in parallel with the developing roller 32 within the developer container 28. The pair of screw conveyors 30*a* and 30*b* are extended between the opposite side walls of the developer container 28, and a length of the partition plate 30*c* is smaller than those of the screw conveyors 30*a* and 30*b* such that each of the opposite ends of the partition plate 30*c* is spaced a predetermined distance apart from a corresponding side wall of the developer container 28. The screw conveyors 30*a* and 30*b* are driven so as to move the developer in opposite directions, to thereby produce a circulating path for the developer. In particular, when the screw conveyor 30*a* thrusts the developer one end thereof, the developer is moved to a corresponding end of the screw conveyor 30*b* around a corresponding end of the partition plate 30*c*. When the screw conveyor 30*b* thrusts the developer to the other end thereof, the developer is moved to the other end of the screw conveyor 30*a* around the other end of the partition plate 30*c*. Thus, the developer is circulated along the screw conveyors 30*a* and 30*b*.

Figure 2:
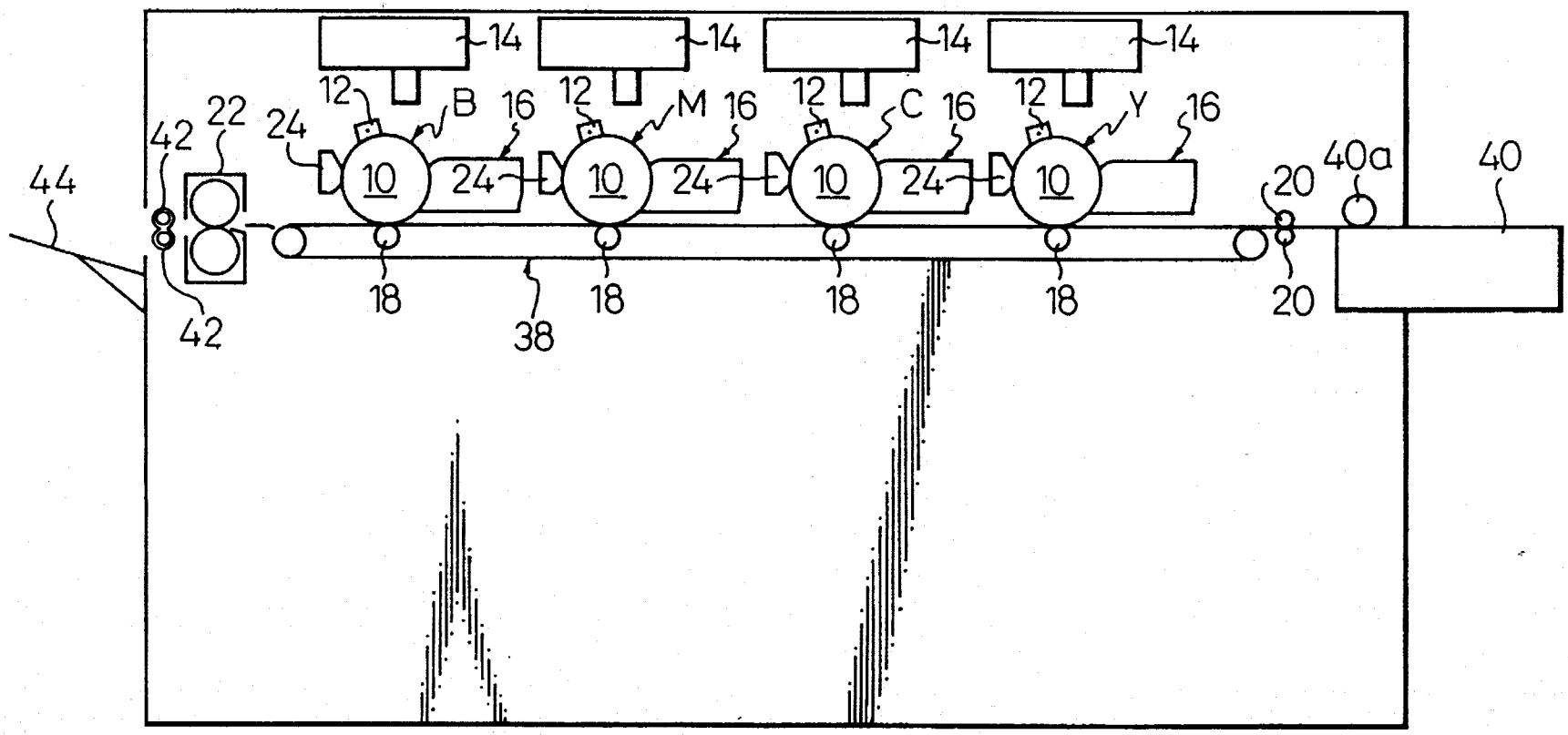
Fig. 2 PRIOR ART
FIG. 2 is a schematic elevation view showing a conventional multicolor image forming apparatus constituted by using a plurality of electrostatic recording units as shown in FIG. 1.

FIG. 2 schematically shows, by way of example, a conventional multi-drum type of multicolor recording apparatus constituted for full-color recording. In particular, the apparatus is provided with four electrostatic recording units Y, C, M and B, as shown in FIG. 1, and these electrostatic recording units are identical with each other, and are arranged in series along an upper run of endless conveyor belt means 38 for conveying a recording sheet of paper. In FIG. 2, elements like or corresponding to those shown in FIG. 1 are designated by the same references. Each of the electrostatic recording units Y, C, M and B features a laser beam scanner used as the optical writing means 14, and an electrically conductive transfer roller as the transfer device 18. During a recording operation, each of the conductive transfer rollers 18 is pressed against the corresponding photoconductive drum 10 through the intermediary of the upper run of the endless conveyor belt means 38. The respective developing devices 16 of the recording units Y, C, M and B use a developer composed of a yellow toner component, a developer composed of a cyan toner component, a developer composed of a magenta toner component, and a developer composed of a black toner component, respectively. The electrostatic recording units Y, C, M and B form and record a yellow toner image, a cyan toner image, a magenta toner image, and a black toner image on a sheet of paper, respectively.

In particular, a pair of register rollers 20 is provided near one end or the inlet end of the endless conveyor belt means 38, and a sheet of paper is fed from the a paper feeder unit 40 toward the pair of register rollers 20. The sheet of paper is stopped to be on standby at the register rollers 20. Electrostatic latent images are written sequentially on the basis of color image data on the photoconductive drums 10 of the electrostatic recording units Y, C, M and B, respectively, and the sheet of paper is sequentially passed through the electrostatic recording units Y, C, M and B at a given timing, whereby a yellow toner image, a cyan toner image, a magenta toner image, and a black toner image are sequentially transferred to the sheet of paper to thereby form a full-color image. The sheet of paper carrying the full-color image is passed through a fixing devise 22 provided near the other end or the outlet end of the endless conveyor belt means 38, to thereby fix the full-color image on the sheet of paper. Thereafter, the sheet of paper is delivered by delivery rollers 42 onto a paper receiver unit 44 which is formed as a paper receiver tray.

As discussed hereinbefore, in the conventional arrangement of the multicolor recording apparatus as shown in FIG. 2, the paper feeder unit 40 and the paper receiver unit 44 are assembled in a housing of the apparatus so as to be extended therefrom. Thus, an area to be occupied by the whole structure of the apparatus for installation thereof, that is, an area occupied by a projection of the whole structure of the apparatus on a floor becomes larger.

Figure 3:
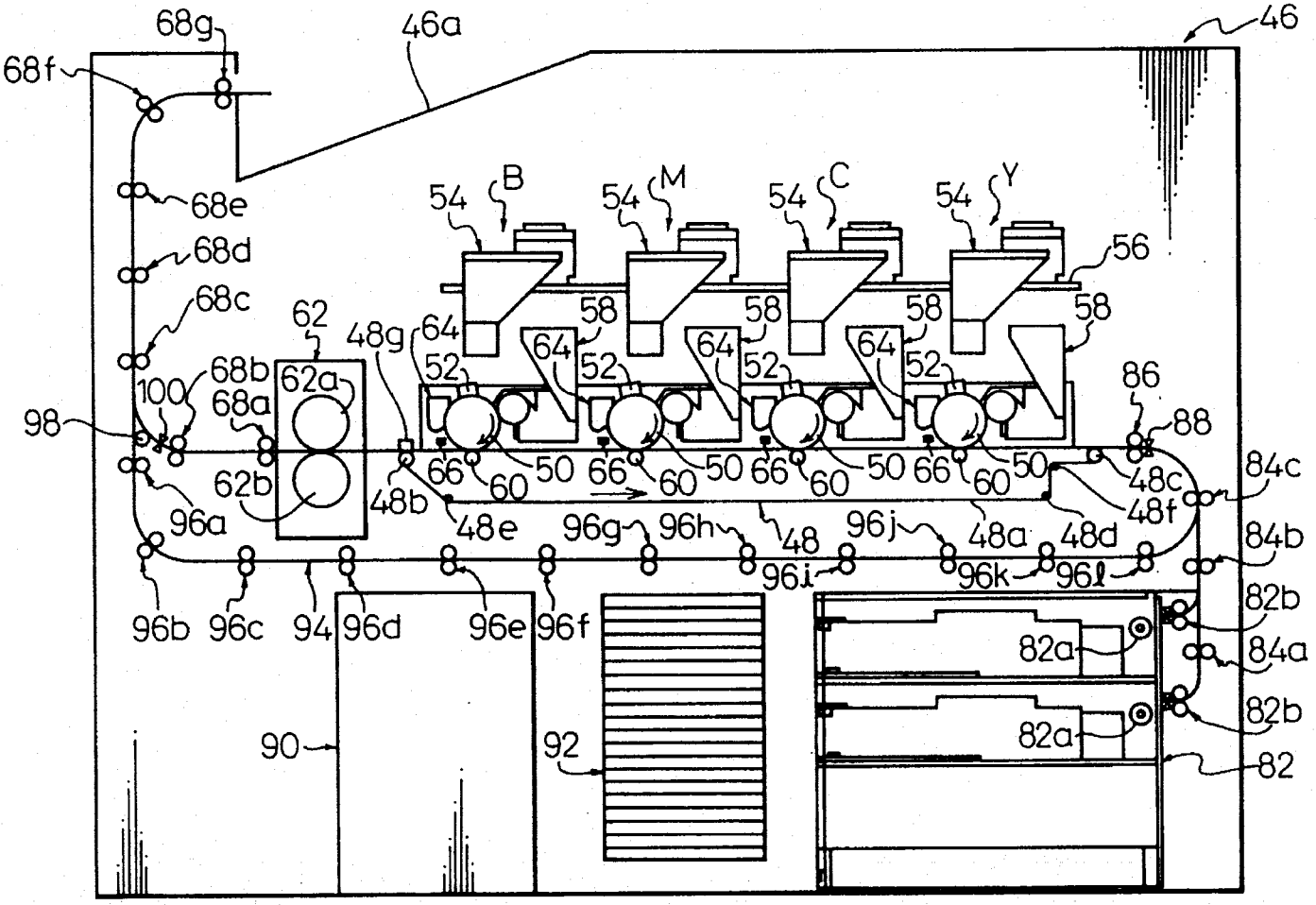
FIG. 3 is a schematic elevation view showing an embodiment of a multicolor image forming apparatus according to the present invention.

FIG. 3 schematically shows an overall arrangement of a multi-drum type multicolor image forming apparatus according to the present invention. The apparatus comprises a housing 46, and an endless conveyor belt means 48 for transporting a recording medium such as a recording sheet of paper is provided substantially in the middle of the housing 46. The endless conveyor belt means 48 comprises an endless belt **48*a* formed by a bendable dielectric material, for example, an appropriate synthetic resin material, and the endless belt 48*a* is engaged with four rollers 48*b*, 48*c*, 48*d* and 48*e*. The roller 48*b* serves as the drive roller, and drives the endless belt 48*a* in a direction, indicated by an arrow in FIG. 3, by an appropriate driving mechanism (not shown). The roller 48*c* serves as a driven roller, and this driven roller 48*c* also functions as an electrically charging roller for giving an electric charge to the endless belt 48*c*. Both of the rollers 48*d* and 48*e* serve as guide rollers, and are arranged close to the drive roller 48*b* and the driven roller 48*c*, respectively. A tension roller 48*f* is provided between the driven roller 48*c* and the guide roller 48*e*, and an appropriate tension is given to the endless belt 48*a* by the tension roller 48*f*. An upper run of the endless belt 48*a* defined between the drive roller 48*b* and the driven roller 48*c* forms a paper moving path for the movement of the sheet of paper to be recorded. The sheet of paper is introduced into the paper moving path at the side of the driven roller 48*c*, and is ejected from the paper moving path at the side of the drive roller 48*b*. When the sheet of paper is introduced into the paper moving path at the side of the driven roller 48*c*, the sheet of paper is electrostatically attracted to the upper run of the endless belt 48*a* due to the charging roller or driven roller 48*c*. An AC charge eliminator 48*g* is provided just above the drive roller 48*b* defining the paper ejecting end of the paper moving path, and the electric charges are eliminated from the endless belt 48*a* by the AC charge eliminator 48*g*. Therefore, when the sheet of paper is ejected from the paper moving path, the sheet of paper can be easily separated from the endless belt 48*a***.

In this embodiment, the multicolor image forming apparatus is provided with four electrostatic recording units Y, C, M and B, as shown in FIG. 2, and these electrostatic recording units are arranged in series along the upper run of the endless belt **48*a* from the upstream side thereof toward the downstream side. The electrostatic recording units Y, C, M and B are identical with each other except that these units Y, C, M and B form and record a yellow toner image, a cyan toner image, a magenta toner image, and a black toner image on the sheet of paper moving along the upper run of the endless belt 48*a*. Each of the electrostatic recording units is provided with a photosensitive drum 50. During the recording operation, the photosensitive drum 50 is rotated in the direction of the arrow shown in FIG. 3. A procharger 52, which may be a corona charger or a scorotron charger, is arranged above the drum 50. The rotating surface of the photosensitive drum 48 is sequentially electrically charged by uniform electric charges by the procharger 52. An electrostatic latent image is written in the charged area of the drum 50 by an optical writing means such as a laser beam scanner 54. The laser beam scanner 54 is fixed and supported by the supporting body 56 forming a part of a main frame in the housing 46**.

Each of the electrostatic recording units is also provided with a developing device 58, and the electrostatic latent image written on the photosensitive drum 50 is electrostatically developed as the charged toner image with a given color toner by the developing device 58. The developing device 58 is arranged upstream of the paper moving path with respect to the photosensitive drum 50 associated therewith. The charged toner image is electrostatically transferred to the recording sheet of paper by an electrically conductive transfer roller 60 positioned beneath the photosensitive drum 40. As shown in FIG. 3, the transfer roller 60 is brought into contact with the drum 50 through the intermediary of the upper run of the endless belt **48*a*, and provides an electric charge having an opposite polarity to that of the charged toner image, to the sheet of paper on the endless belt 48*a*, whereby the charged toner image is electrostatically transferred from the drum 50** onto the sheet of paper.

According to the above arrangement, when the sheet of paper is introduced into the paper moving path defined by the upper run of the endless conveyor belt means 48, and sequentially passes through the electrostatic recording units Y, C, M and B, toner images of four colors are superimposed on the sheet of paper, whereby a full color image is formed thereon. Subsequently, the sheet of paper is ejected from the paper moving path, and is then fed to a heat fixing unit 62 in which the full-color image is thermally fused and fixed on the sheet of paper. The heat fixing unit 62 is a well known type comprising a heat roller **62*a* and a back-up roller 62*b*. On the other hand, in each of the electrostatic recording units, residual toner not transferred from the photosensitive drum 50 to the sheet of paper is removed by a cleaning device 64, and the cleaning device 64 is provided on the downstream side of the paper moving path with respect to the photosensitive drum 50. Note that, in FIG. 3, the reference numeral 66 indicates a light emitting device such as a light emitting diode array for removing the remaining electric charges from the surface of the photosensitive drum 50** after the transfer process.

The sheet of paper passed through the heat fixing unit 62 is conveyed in a substantially vertical direction along a paper ejecting passageway defined by a large number of guide roller assemblies **68*a* through 68*g* together with guide plate elements extended therebetween, and is then ejected onto a paper receiving tray 46***a* integrally formed on a top wall of the housing 46. Note that, by appropriately installing the drive roller in the sheet guide roller assemblies 68*a* through 68*g*, it is possible to reliably feed the sheet of paper onto the paper receiving tray 46*a*.

Figure 4:
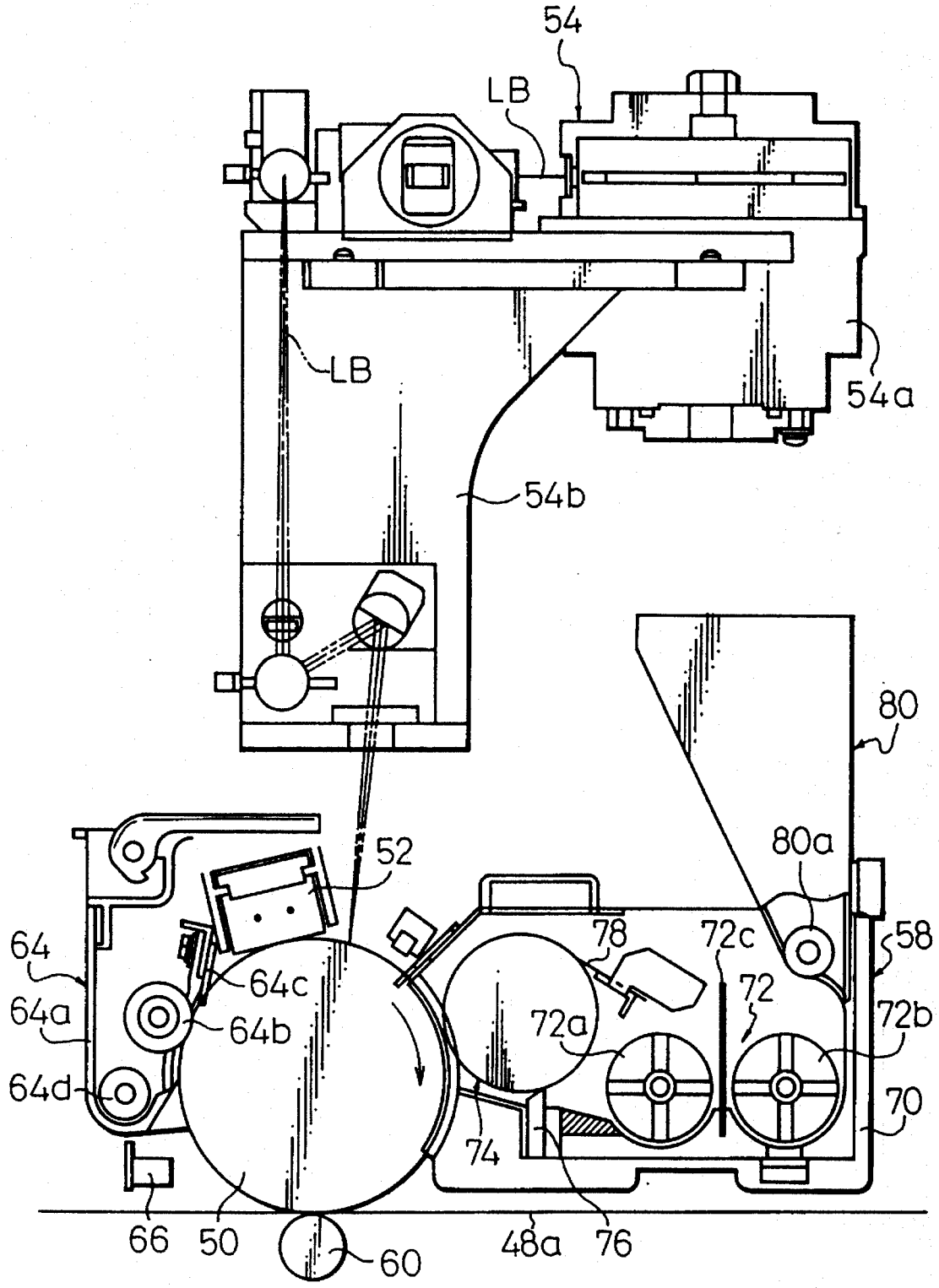
FIG. 4 is an elevation view illustrating one of the electrostatic recording units of the multicolor image forming apparatus shown in FIG. 3 in detail.

Referring to FIG. 4, one of the electrostatic recording units (Y, C, M, B) is illustrated in detail. The laser beam scanner 54 comprises a laser beam generator 54*a* and an optical system 54*b* including various optical elements for guiding the laser beam LB emitted from this laser beam generator 54*a* toward the photosensitive drum 50.

The developing device 58 is substantially identically with the developing device 16 explained referring to FIG. 1. Namely, the developing device 58 is provided with a container 70 for holding a two-component developer, an agitator 72 for agitating the two-component developer held in the developer container 70, to cause the toner component and the magnetic carrier component to be subjected to triboelectrification, and a magnet roller or developing roller 74 for forming a magnetic brush therearound by magnetically attracting a part of the magnetic carrier component. The developing roller 74 is partially exposed from the developer container 70 and faces the photosensitive drum 50. The toner component is electrostatically attracted to the magnetic brush formed around the developing roller 74, and is brought to a facing zone or developing zone to the photosensitive drum 50 due to the rotation of the developing roller 74, whereby development of an electrostatic latent image can be carried out. Since the density of a developed toner image is dependent on a quantity of toner brought to the developing zone, the height of the magnetic brush is regulated by a doctor blade 76 to ensure evenness of the density of development. The developer which has passed through the developing zone, i.e., the developer having a reduced toner component, is scraped off the developing roller 78 by a scraper blade 78, and is then returned to the agitator 72.

The agitator 72 comprises a pair of screw conveyors 72*a* and 72*b* extended between both end walls of the container 70, and the screw conveyors 72*a* and 72*b* are arranged in parallel to each other. As shown in FIG. 4, a partition plate 72*c* is arranged between the screw conveyors 72*a* and 72*b*, and upright extended from a bottom of the developer container 70. The length of the partition plate 72*c* is shorter than the length of the screw conveyors 72*a* and 72*b*, and each of the ends thereof is separated from the corresponding side wall of the container 70 by a given distance. Accordingly, in the same way as the case of the screw conveyors 30*a* and 30*b* explained referring to FIG. 1, a path of circulation of the developer is formed by the screw conveyors 72*a* and 72*b*.

Further, the developing device 58 is provided with a toner supplying tank 80 provided at a top of the developer container 70, and the toner supplying tank 80 has a toner supplying paddle roller 80*a* provided in an exit port formed in a bottom of the toner supplying tank 80. By rotating the toner supplying paddle roller 80*a*, the toner component is appropriately supplied to the developer held in the developer container 70.

Also, the cleaning device 64 is similar to the type explained referring to FIG. 1. Namely, the cleaning device 64 comprises a toner collecting vessel 64*a* having an opening for receiving a part of the photosensitive drum 50, a fur brush 64*b* provided in the toner collecting vessel 64*a* close to the opening thereof, a toner scraping blade 64*c* provided along an upper edge of the opening of the toner collecting vessel 64*a*, and a screw conveyor 64*d* provided at a bottom of the toner collecting vessel 64*a*, The residual toner is brushed off from the surface of the photosensitive drum 50 by the fur brush 64*b*, and the part of the residual toner not brushed off by the fur brush 64*b* is further scraped by the scraping blade 64*c*. The residual toner removed by the fur brush 64*b* and the scraping blade 64*c* is collected in the toner collecting vessel 64*a*, but the collected toner is conveyed from the toner collecting vessel 64*a* to a given location by the screw conveyor 64*d*.

Referring to FIG. 3 again, a paper feeder unit 82 is disposed on the right side (in FIG. 3) of a bottom of the housing 46, i.e., beneath the paper introduction side of the endless conveyor belt means 48, and includes two paper feed cassettes arranged vertically therein and accommodating stacks of the paper sheets, respectively. Each of the paper feed cassettes is provided with a feed out roller 82*a*, and a pair of paper feed rollers 82*b*. Three paper guide roller assemblies 84*a*, 84*b* and 84*c* and a pair of register rollers 86 are provided between the paper feeder unit 82 and the driven roller 48C of the endless conveyor belt means 48, and define a paper feeding passageway together with guide plates elements extended herebetween. The register rollers 86 are arranged adjacent to the driven roller 48*c*. In each of the paper feed cassettes, the sheets of paper are fed out one by one from the stack of paper sheets by the feed out roller 82*a*, and the sheets of paper are guided to the paper feeding passageway by the paper feed rollers 82*b*, and are sent toward the register rollers 86. Note that, by appropriately installing the drive roller in the paper guide roller assembly 84*b* or 84*c*, it is possible to reliably send the sheet of paper from the paper feeder unit 82 to the register rollers 86. An appropriate sheet sensor 88 is arranged on a paper introduction side of the register rollers 86. When a leading edge of the sheet of paper is detected by the sheet sensor 88, the sheet of paper is stopped at the position of the register rollers 86 and is made to stand by. Subsequently, the sheet of paper is introduced into the paper moving path, defined by the upper run of the endless conveyor belt means 48, by the register rollers 86 at a given timing in accordance with the writing of the electrostatic latent image by the electrostatic recording units (Y, C, M, B), whereby a yellow toner image, a cyan toner image, a magenta toner image, and a black toner image are sequentially transferred to the sheet of paper and are superimposed thereon in a proper positional relationship.

As shown in FIG. 3, an electrical power source unit 90 is arranged on the left side (in FIG. 3) of the bottom of the housing 46, i.e., beneath the paper ejection side of the endless conveyor belt means 48, and an electronic control unit 92 is arranged between the paper feeder unit 82 and the power source unit 90.

In this embodiment, the multicolor image forming apparatus is constituted so that two-sided recording can be performed on a sheet of paper. To this end, a paper bypass passageway 94 is provided at a space between the endless conveyor belt means 48 and the units 82, 90 and 92. The paper bypass passageway 94 is defined by a plurality of paper guide roller assemblies 96*a* through 96*l* together with guide plate elements extended therebetween, The paper guide roller assembly 96*a* is arranged so as to continue to the sheet guide roller assembly 68*c*, and the paper guide roller assembly 96*l* is arranged so as to continue to the sheet guide roller assembly 84*c*. Also, a paper switching roller 98 is provided between the sheet guide roller assembly 96*a* and the sheet guide roller assembly 68*b*, and a sheet sensor 100 is arranged on a paper ejection side of the sheet guide roller assembly 68*b*, When a two-side recording is performed, the sheet of paper (only the front side of which being recorded)

ejected from the heat fixing unit 62 is once fed into the paper ejecting passage way defined by the paper guide roller assemblies 68*a* through 68*g*, but immediately after the trailing edge thereof is detected by the paper sensor 100, the sheet of paper is sent in a reverse direction and is guided to the paper bypass passageway 94 by the paper switching path 98. The sheet of paper sent by the paper bypass passageway 94 is guided to the sheet guide roller assembly 84*c*, and is then fed into the paper introduction side of the endless conveyor belt means 48 again via the register rollers 86. Thus, a recording is made on the back side of the sheet of paper. The sheet of paper, on which the two-sided recording is made, passes through the heat fixing unit 62, and is then ejected to the paper ejecting tray 46*a* similar to the case of one-sided recording. Note that, by appropriately installing the drive roller in the sheet guide roller assemblies 96*a* through 96*l*, the sheet of paper is reliably sent along the paper bypass passageway 94 to the register rollers 86.

As characteristic features of the arrangement of the multicolor image forming apparatus as shown in FIG. 3, there can be mentioned the point that the paper feeder unit 82 is arranged beneath the paper introduction side of the endless conveyor belt means 48 and, in addition, that the paper receiving tray 46*a* is arranged above the heat fixing unit 62; the point that both of the electrical power source unit 90 and the electronic controller unit 92 are arranged beneath the endless conveyor belt means 48; and further the point that the paper bypass passageway 94 for the two-sided recording is arranged at the space between the endless conveyor belt means 48 and the 82, 90 and 92. With this arrangement, the area occupied by the whole structure of the apparatus for the installation thereof, i.e., an area occupied by a projection of the whole structure of the apparatus on a floor can be greatly reduced. This can be easily understood from the comparison the arrangement of FIG. 3 with the conventional arrangement of FIG. 2.

Figure 5:
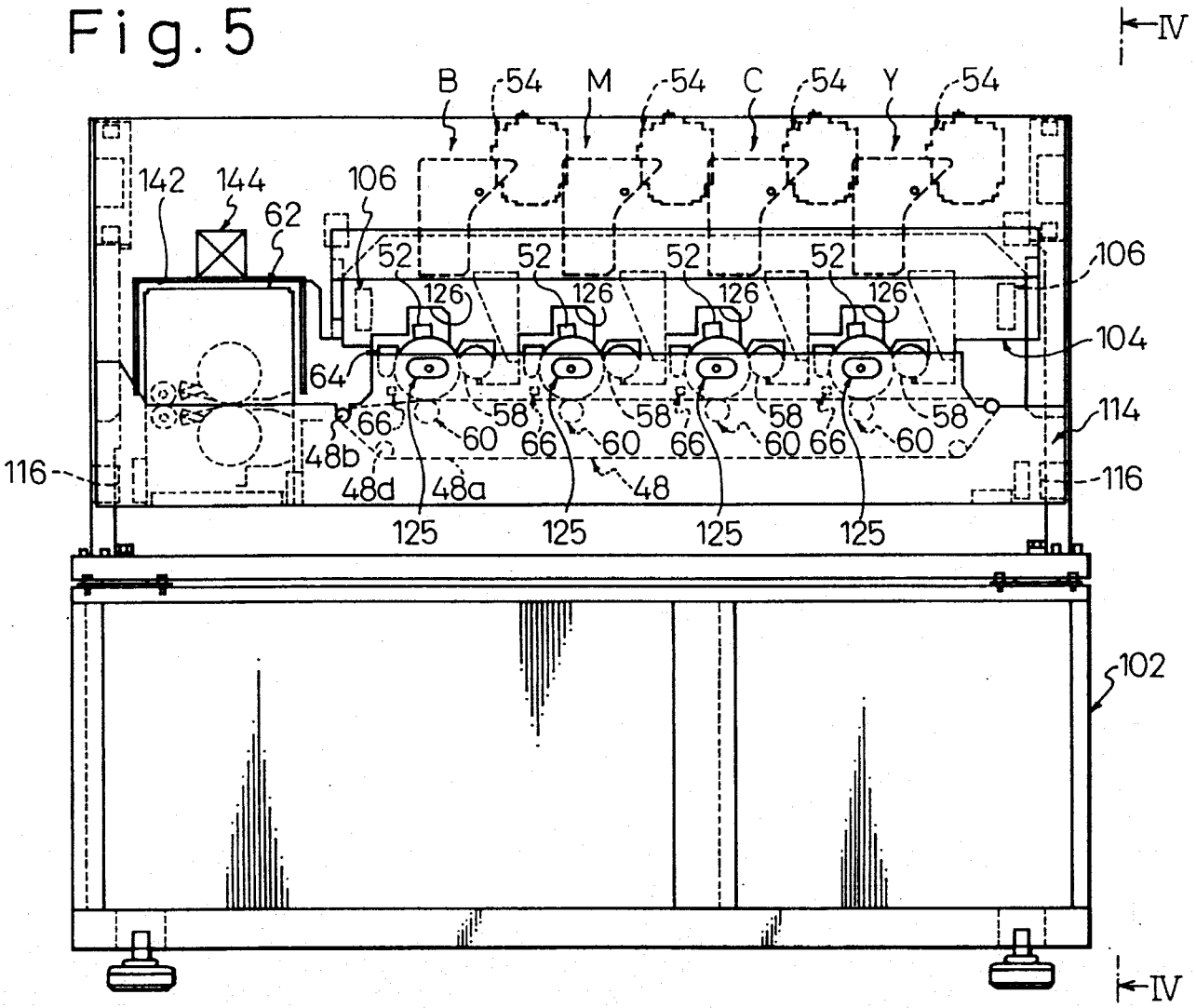
FIG. 5 is an elevation view showing the multicolor image forming apparatus shown in FIG. 1 together with a main frame and sub-frames thereof.
Figure 6:
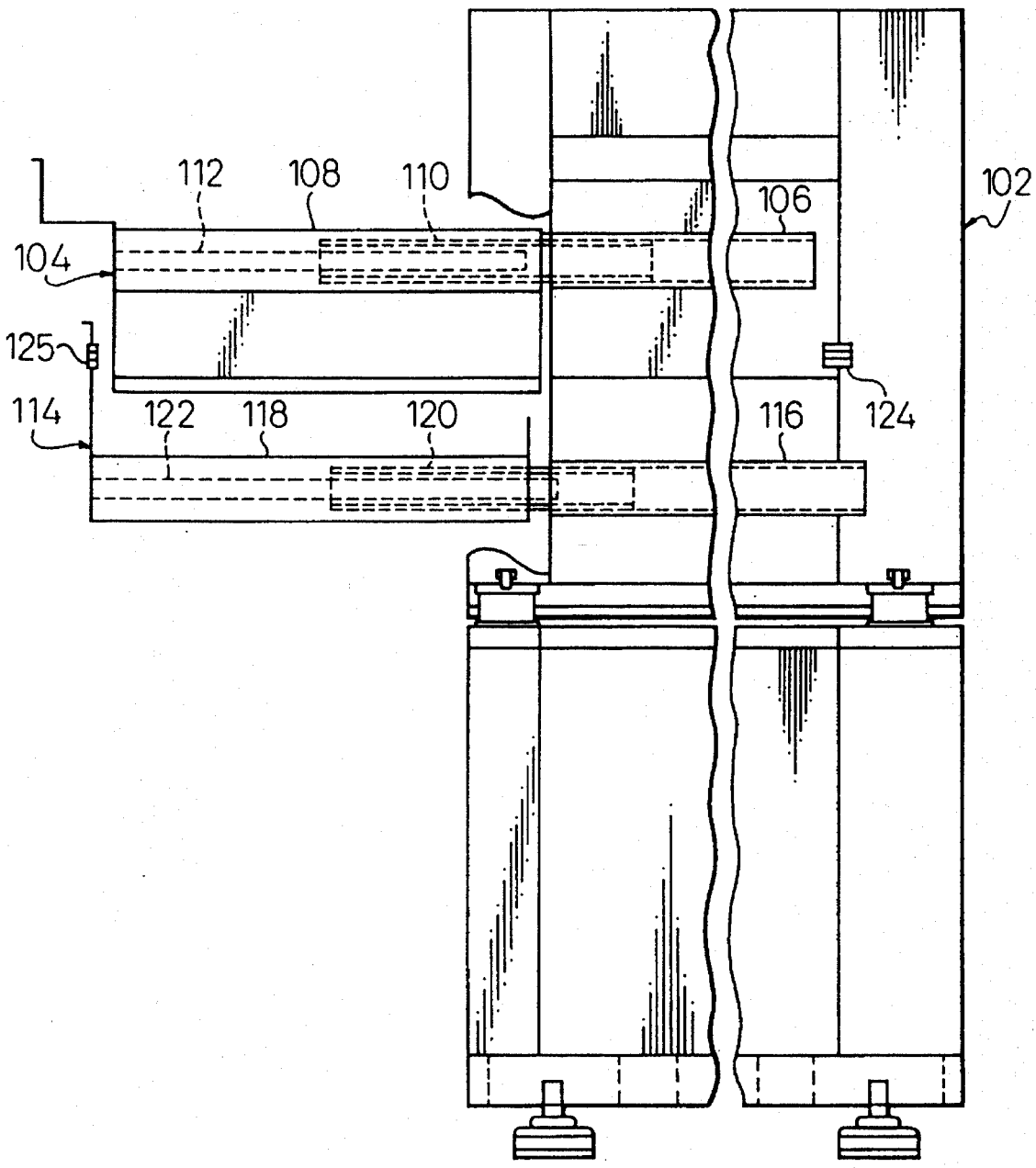
FIG. 6 is a side view observed along a line VI—VI of FIG. 5, showing a positional relationship between the main frame and the first and second sub-frames.

FIGS. 5 and 6 shows a main frame of the multicolor image forming apparatus according to the present invention indicated by a reference numeral 102, and this main frame 102 is accommodated in the housing 46. A first sub-frame 104 is movably provided in the main frame 102, and is extended along the endless conveyor belt means 48. The first sub-frame 104 is movably supported such that it is slidable along two immovable guide rails 106 provided on the end sides thereof. In particular, the first sub-frame 104 is securely attached to two movable guide rails 108 which are in telescopic engagement with the corresponding immovable guide rails 106 securely fixed to to the main frame 102, respectively, and an intermediate guide rail 110 is in slidable engagement with both of the immovable and movable guide rails 106 and 108 telescopically engaged with each other. Each of the movable guide rails 108 has a ridge element 112 integrally formed therewith and longitudinally extended therealong, and the ridge element 112 is slidably engaged in a slot formed in the corresponding intermediate guide rail 110. Thus, the first sub-frame 104 can be pulled to the outside of the main frame 102 in the transverse direction to the endless conveyor belt means 48, as shown in FIG. 6. Suitable stopper elements (not shown) are provided on the immovable guide rail 106, the intermediate guide rail 110, and the ridge element 112 to be abutted to each other such that, when the first sub-frame 104 is pulled out, the stopper elements guarantee that the immovable guide rail 106, the movable guide rail 108 and the intermediate guide rail 110 are at the relative positions as shown in FIG. 6, and thus the movable guide rail 108 of the first sub-frame 104 is prevented from dropping out of the immovable guide rail 106.

Also, a second sub-frame 114 is movably provided in the main frame 102, and is extended along the endless conveyor belt means 48. The second sub-frame 114 is movably supported such that it is slidable along two immovable guide rails 116 provided on the end sides thereof. Similar to the first sub-frame 104, the second sub-frame 114 is securely attached to two movable guide rails 118 which are in telescopic engagement with the corresponding immovable guide rails 116 securely fixed to to the main frame 102, respectively, and an intermediate guide rail 120 is in slidable engagement with both of the immovable and movable guide rails 116 and 118 telescopically engaged with each other. Each of the movable guide rails 118 has a ridge element 122 integrally formed therewith and longitudinally extended therealong, and the ridge element 122 is slidably engaged in a slot formed in the corresponding intermediate guide rail 120. Thus, the second sub-frame 114 can be pulled to the outside of the main frame 102 in a direction transversal to the endless conveyor belt means 48, as shown in FIG. 6. Suitable stopper elements (not shown) are provided on the immovable guide rail 116, the intermediate guide rail 120, and the ridge element 122 such that, when the second sub-frame 114 is pulled out, the stopper elements guarantee that the immovable guide rail 116, the movable guide rail 118 and the intermediate guide rail 120 are at the relative positions as shown in FIG. 6, and thus the movable guide rail 118 of the second sub-frame 114 is prevented from dropping out of the immovable guide rail 116.

Figure 7:
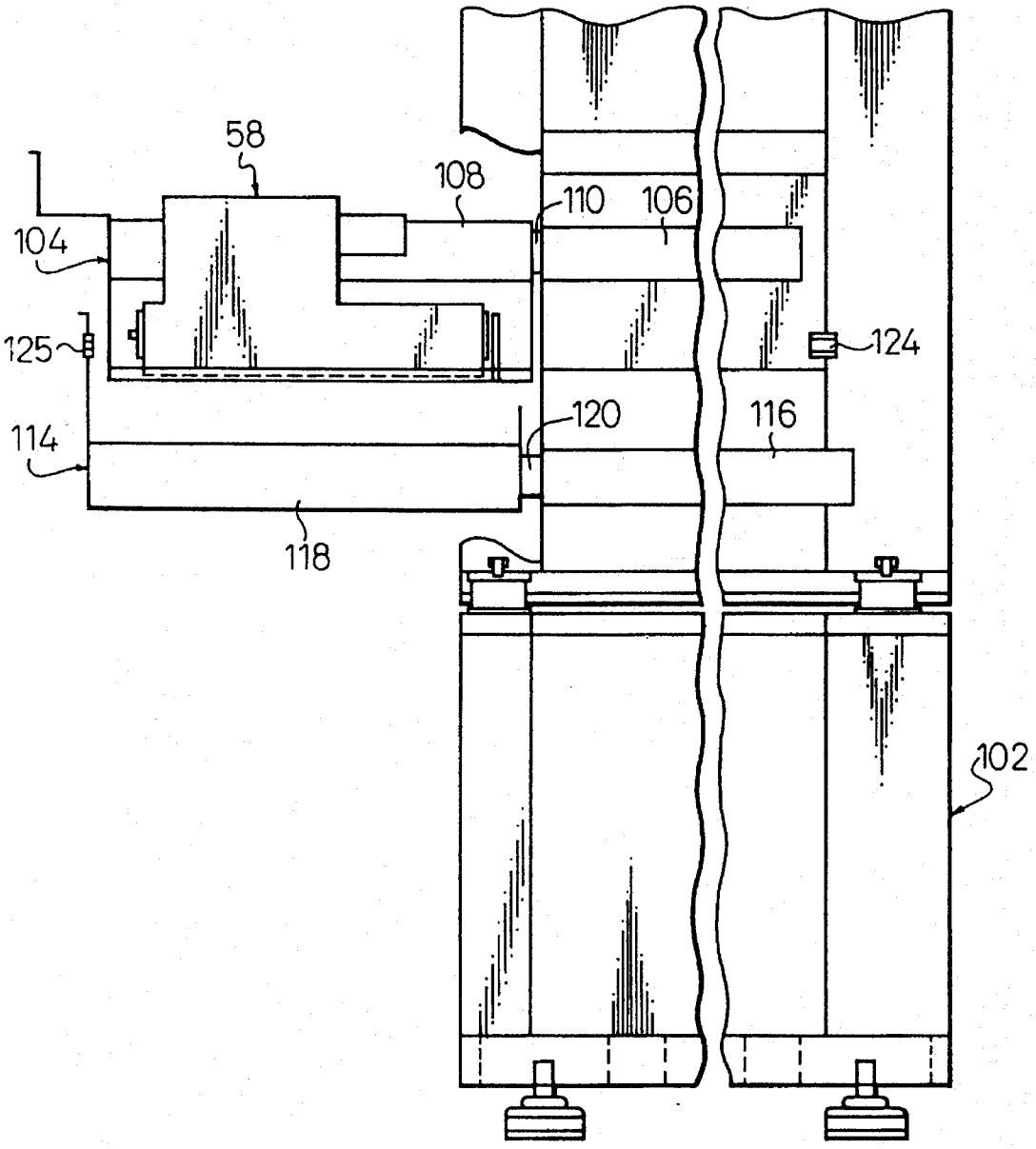
FIG. 7 is a side view similar to FIG. 6, showing the same in a state where a developing device is mounted on the first sub-frame.
Figure 8:
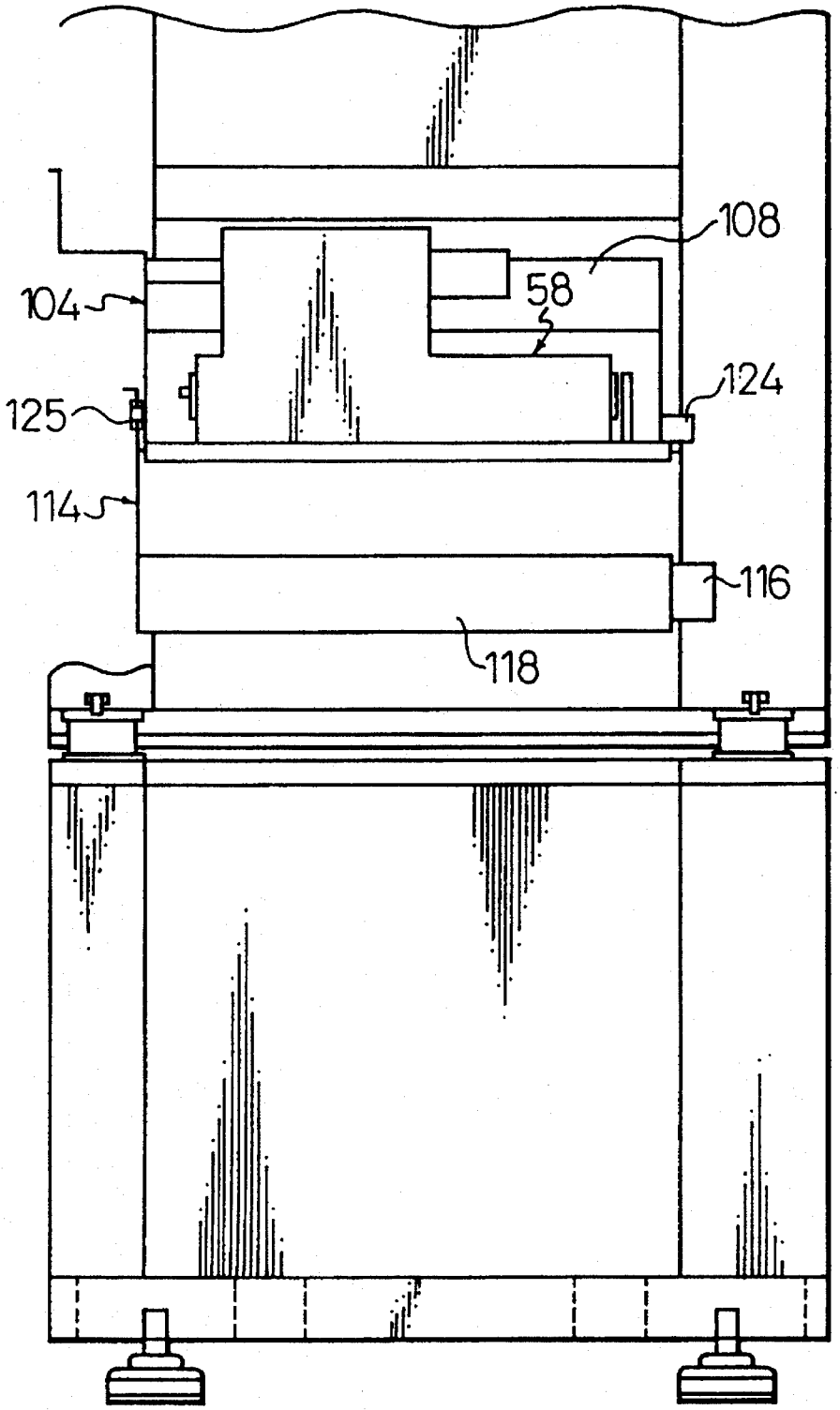
FIG. 8 is a side view similar to FIG. 6, showing the same in a state where the first and second sub-frames are at a setting position.

The photosensitive drums 50 and the developing devices 58 of the four electrostatic recording units Y, C, M and B are detachably mounted on and supported by the first sub-frame 104, and the procharger 52, the cleaning device 64 and the light emitting device 66, etc. are united with and held by the drum 50. On the other hand, the endless conveyor belt means 48, the transfer roller 60, the heat fixing unit 62, and the paper guide roller assemblies 96*c* through 96*l* forming a part of the paper bypass passageway 94 are mounted on and supported by the second sub-frame 114. Both of the first sub-frame 104 and the second sub-frame 114 are made to be movable between the pulled-out position shown in FIG. 7 and the pushed-in position shown in FIG. 8. Before the first sub-frame 104 can be drawn out of the main frame 102, it is necessary to draw the second sub-frame 114 out of the main frame 102. This is because the drum 50 and the developing device, etc. mounted on the first sub-frame 104 interfere with a front wall portion of the second sub-frame 114 when drawing out the first sub-frame 104, as apparent from FIG. 5. In FIG. 7 and FIG. 8, although only the developing devices 58 is mounted on the first sub-frame 104 for simplification of illustration, of course, the drums 50 etc. are also mounted on the first sub-frame 104. Similarly, although the endless conveyor belt means 48, the transfer roller 60, the heat fixing unit 62, etc. are mounted on the second sub-frame 114, these constituent elements are omitted in FIG. 7 and FIG. 8 to simplify the illustration.

Figure 9:
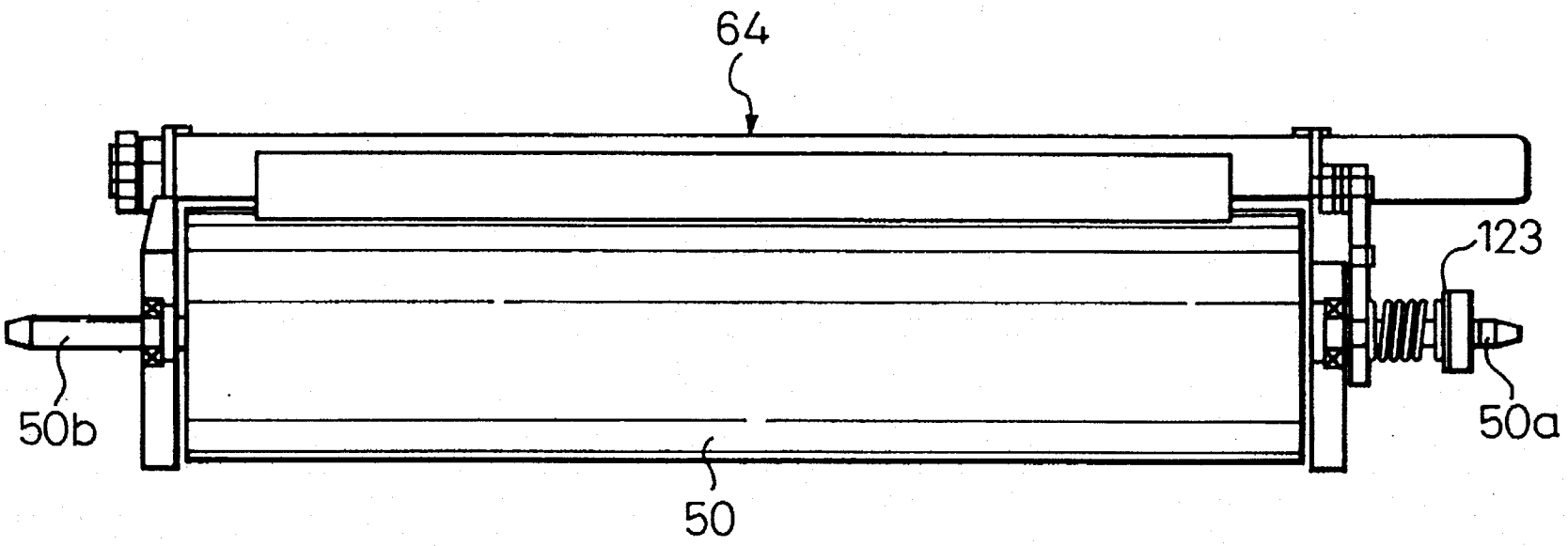
FIG. 9 is a plan view of a photosensitive drum to be mounted on the first sub-frame.

When the first sub-frame 104 is moved to the pushed-in position of FIG. 8, the photosensitive drum 50 must be located at a given proper position. To this end, as shown in FIG. 9, shaft ends 50*a* and 50*b* are projected from the two end faces of the drum 50, respectively, and a driven coupling 123 is attached to one (50*a*) of the shaft ends thereof. When the first sub-frame 104 on which the drum 50 is mounted is moved from the pulled-out position of FIG. 7 to the pushed-in position of FIG. 8, the driven coupling 123 of the drum 50 is engaged with the drive coupling 124 (FIGS. 7 and 8) supported by the main frame 102. On the other hand, a positioning bearing 125 (FIG. 7, FIG. 8) is supported by the second sub-frame 114. When the second sub-frame 114 is moved to the pushed-in position after the first sub-frame 104 is moved to the pushed-in position, the positioning bearing 125 is engaged with the shaft end 50*b* of the drum 50, whereby the drum 50 can be located at the given proper position with respect to the main frame 102. In short, the positioning of the drum 50 in an axial direction thereof is guaranteed by the engagement between the driven coupling 123 and the drive coupling 124, and the positioning of the drum 50 in a radial direction thereof is guaranteed by the engagement between the shaft end 50*b* and the positioning bearing 125. Note that, the drive coupling 124 may be subjected to a rotational drive force transmitted from a main motor of the apparatus through a suitable transmission means.

As mentioned above, the precharger 52, the cleaning unit 64, the light emitting device 66, etc. are united with and held by each of the photosensitive drums 50, and openings 126 (FIG. 5) are formed in a front wail portion of the first sub-frame 104 such that each of the drums 50 can be removed together with the constituent elements (52, 64, 66, etc.) from the first sub-frame 104 for maintenance or exchange of these constituent elements. Namely, the removal of the drum 50 carrying the constituent elements from the first sub-frame 104 is possible without interfering with the front wall portion thereof due to the corresponding opening 126 formed in the front wail portion of the first sub-frame 104.

Figure 10:
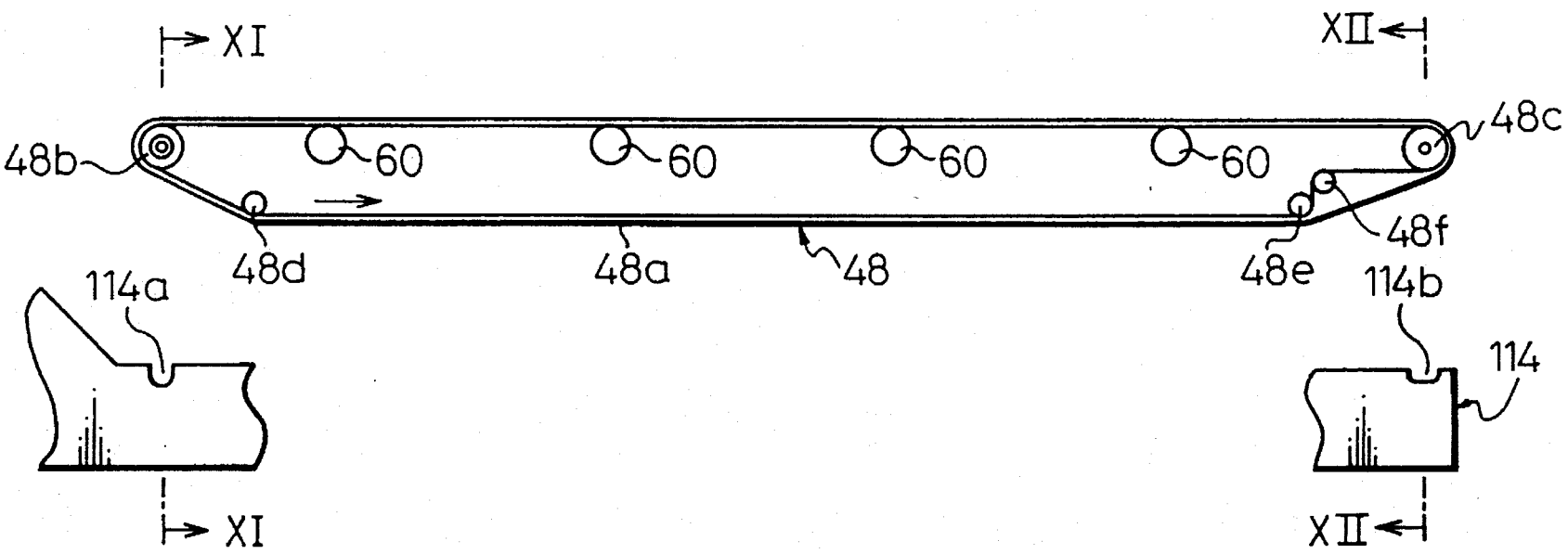
FIG. 10 is a partial elevation view showing a positional relationship between an endless belt transport means and the second sub-frame.
Figure 11:
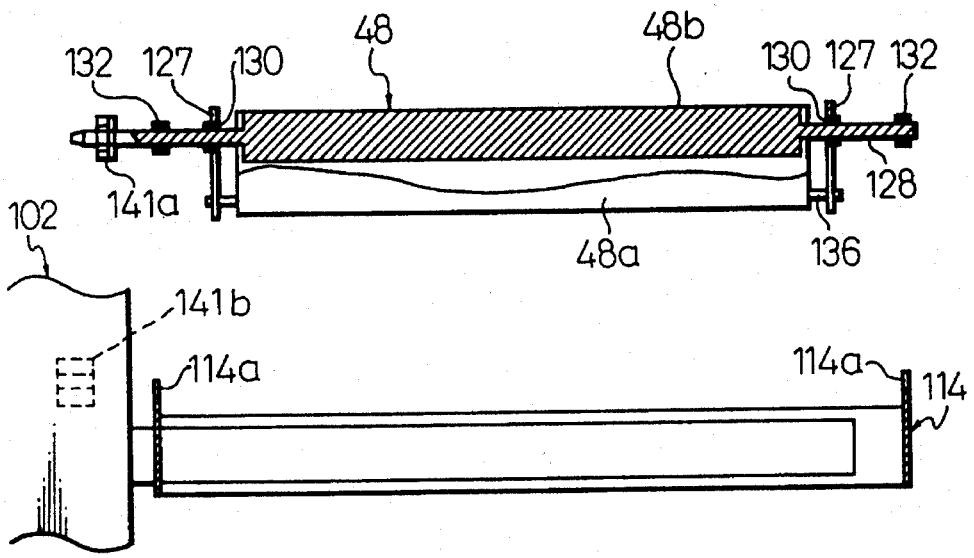
FIG. 11 is a cross-sectional view taken along a line XI—XI of FIG. 10.
Figure 12:
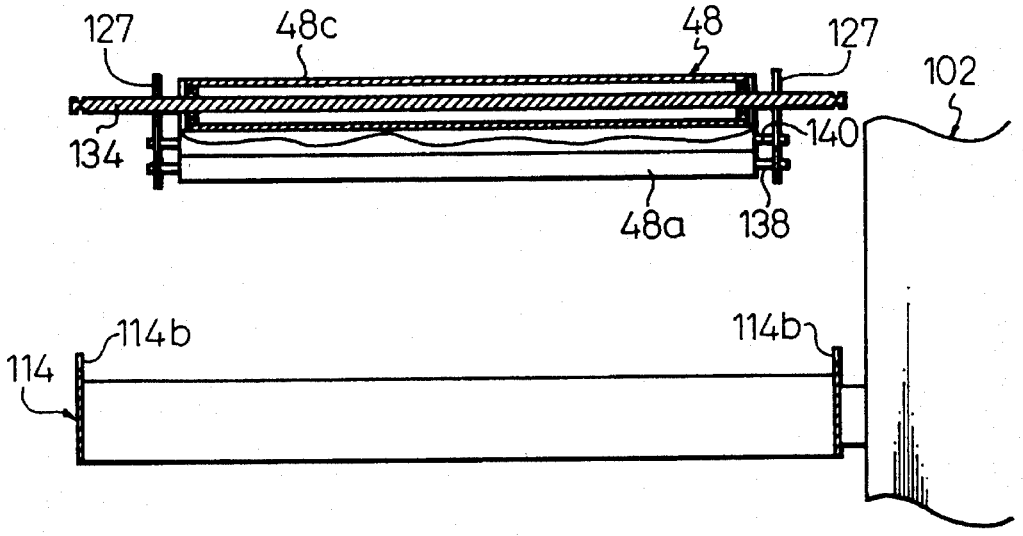
FIG. 12 is a cross-sectional view taken along a line XII—XII of FIG. 10.

As shown in FIGS. 10, 11, and 12, the endless conveyor belt means 48 is constituted as an independent assembly, and this assembly comprises a pair of side plates 127. As apparent from FIG. 11, a drive shaft 128 of the drive roller 48*b* is rotatably supported by the side plates 127 via appropriate bearings 130 provided in the respective side plate 127. Further, both end portions of the drive shaft 132 are provided with other bearings 132 mounted thereon, and the bearings 132 are received and held in recesses 114*a* formed in the front and rear wall portions of the second sub-frame 114, respectively (FIGS. 10 and 11). Also, as is apparent from FIG. 12, the driven roller 48*c* is rotatably mounted on a shaft 134 securely supported by the side plates 127, and both end portions of the shaft 134 are received and held in recesses 114*b* formed in the front and rear wall portions of the second sub-frame 114. Further, as is apparent from FIGS. 11 and 12, a shaft 136 of the guide roller 48*d*, a shaft 138 of the guide roller 48*e*, and a shaft 140 of the tension roller 48*f* are securely supported by the side plates 127, and the respective rollers are rotatably mounted on the related shafts. Note, in this embodiment, the four electrically conductive transfer rollers 60 are suitably incorporated and installed in the endless conveyor belt assembly 48 mounted on the second sub-frame 114, as shown in FIG. 10.

When the second sub-frame 114 on which the endless conveyor belt assembly 48 is mounted is moved to the pushed-in position, the endless conveyor belt assembly 48 is located at a proper position with respect to the electrostatic recording units Y, C, M and B. As shown in FIG. 11, a driven coupling 141*a* is provided on one end portion of the drive shaft 128 of the drive roller 48*b*. When the second sub-frame 114 is moved to the pushed-in position, the driven coupling 141*a* is engaged with a drive coupling 141*b* provided on the main frame 102. The drive coupling 141*b* may be subjected to a rotational drive force transmitted from the main motor of the apparatus through a suitable transmission means, similar to the case of the drive coupling 124 of the photosensitive drum 50.

The heat fixing unit 62 is also supported by the second sub-frame 114. As shown in FIG. 5, an opening 142 is formed in the front wall portion of the first sub-frame 104 such that an upper portion of the heat fixing unit 62 cannot interfere with the front wall portion of the first sub-frame 104 when the second sub-frame 114 can be drawn out of the pushed-in position to the pulled-out position. Note that a cooling fan 144 is attached to the front portion of the main frame 102 immediately above the heat fixing unit 62, and heat generated from the heat fixing unit 62 is discharged to the outside of the main frame 102 by the cooling fan 144.

Figure 13:
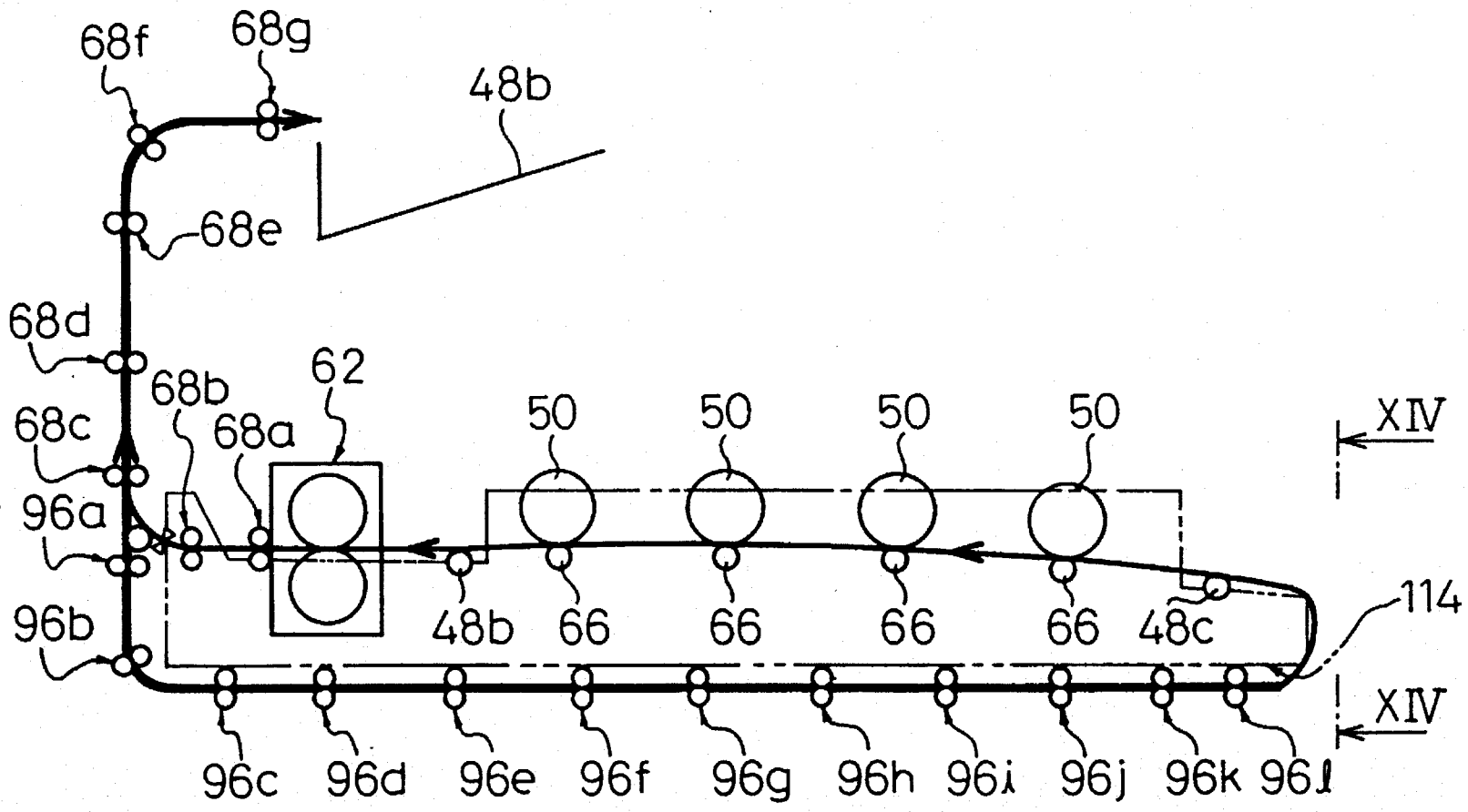
FIG. 13 is a schematic view showing a relative positional relationship between the second sub-frame and principal constituent elements of the apparatus, and particularly a relative positional relationship between the second sub-frame and a paper bypass passageway.
Figure 14:
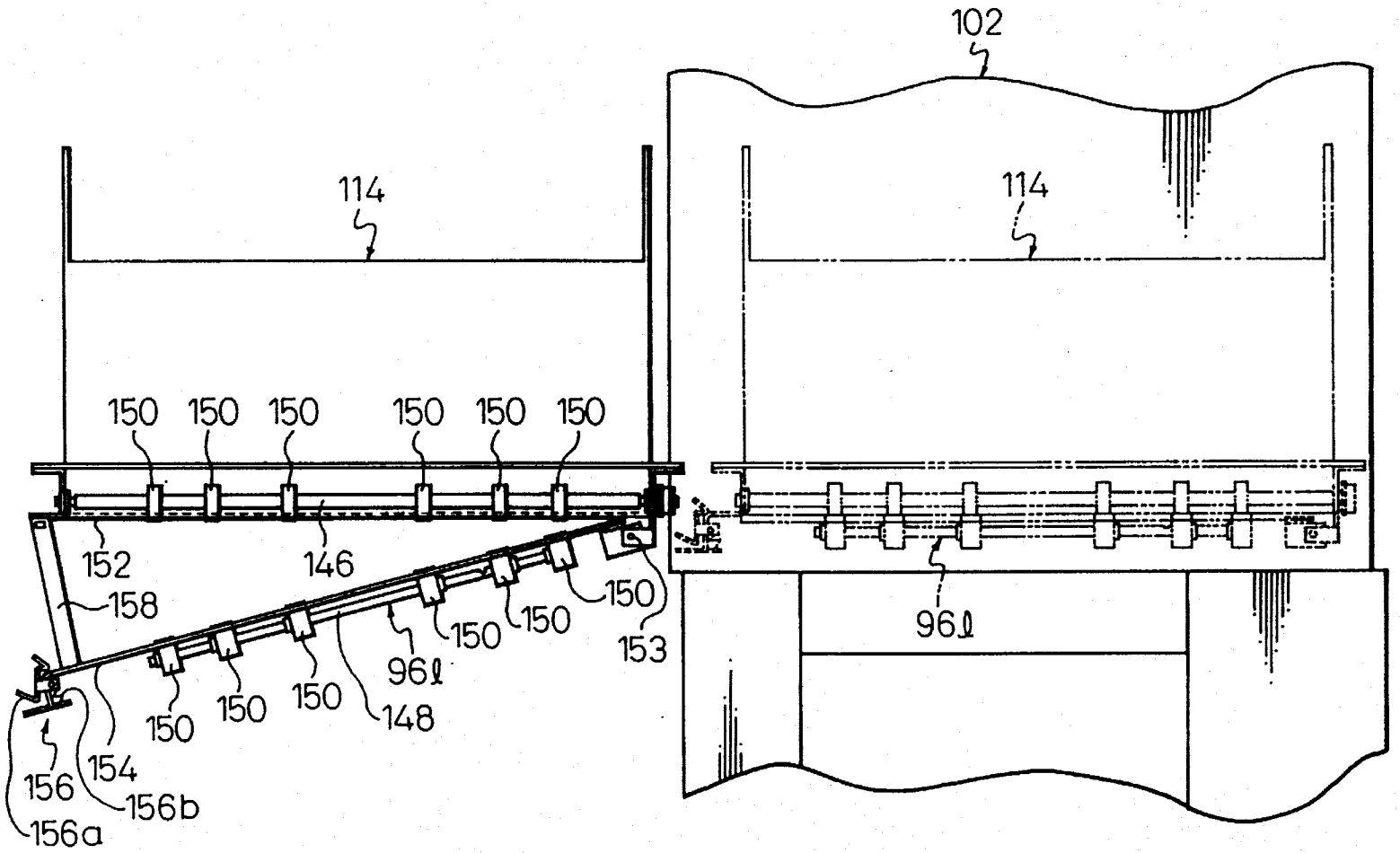
FIG. 14 is a side view observed along a line XIV—XIV of FIG. 13.

FIG. 13 schematically shows a relative positional relationship between the second sub-frame 114 and main constituent elements of the apparatus, particularly a relative positional relationship between the second sub-frame 114 and the paper bypass passageway 94. A plurality of paper guide roller assemblies 96*c* through 96*l* forming a part of the paper bypass passageway 94 are supported by the second sub-frame 114. As is apparent from FIG. 14, which is a cross-sectional view seen along a line XIV—XIV of FIG. 13, each of the paper guide roller assemblies 96*c* through 96*l* is provided with a pair of shaft elements 146 and 148, and six roller elements 150 are respectively attached to each shaft element 146, 148. One shaft element 146 is rotatably attached to the guide plate 152 supported by the bottom portion of the sub-frame 114, and the other shaft element 148 is rotatably attached to the guide plate 154 hinged to the guide plate 152 by a suitable hinge means 153. In FIG. 14, the roller elements 150 of the respective shaft elements 146 and 148 are slightly projected through the openings formed in the respective guide plates 152 and 154, and when the guide plate 154 is pivoted to a position at which it is parallel to the guide plate 152 around the hinge means 153, both roller elements 150 of the shaft elements 146 and 148 are engaged with each other.

As shown in FIG. 14, locking means 156 are provided at a front edge of the guide plate 154 (left side in FIG. 14) at appropriate intervals. Each locking means 156 includes a pivotably fitting piece 156*a*, and a coil spring 156*b* which resiliently biases the pivotably fitting piece 156*a* in a clockwise direction (in FIG. 14). When the guide plate 154 is pivoted to the position at which it is parallel to the guide plate 152, the pivotably fitting piece 156*a* of the locking means 156 rides over the front edge (left side in FIG. 14) of the guide plate 152, and is resiliently locked to the front side edge by the function of the coil spring 156*b*, whereby the guide plate 154 can be held parallel to the guide plate 152. In this way, when the second sub-frame 114 is pushed into the main frame 102 in a state where the guide plate 154 is locked to the guide plate 152, the sheet guide roller assemblies 96*c* through 96*l* are positioned at the predetermined positions, and provide a part of the paper bypass passageway 94 with respect to the sheet of paper on which two-side recording should be carried out.

Also, fabric tapes 158 having predetermined lengths are attached between both front side edges of the guide plates 152 and 154 at appropriate intervals. These fabric tapes 156 restrict the pivoting range of the guide plate 154 when the pivotably fitting piece 156*a* of the locking means 156 is disengaged from the front side edge of the guide plate 152. Namely, when the second sub-frame 114 is drawn out of the main frame 102, and when the pivotably fitting piece 156*a* is disengaged from the front side edge of the guide plate 152, the opening degree of the guide plate 154 with respect to the guide plate 152 is restricted by the fabric tape 158.

According to the arrangement as shown in FIGS. 5 through 14, it is possible to obtain easy access to the main constituent elements of the multicolor image forming apparatus, and therefore not only does the maintenance thereof becomes easy, but also the replacement of the parts etc. can be quickly carried out. Note that, in the above-mentioned embodiment, the heat fixing unit 62 was supported on the second sub-frame 114, but it is also possible to fix and support the heat fixing unit 62 on the main frame 102.

As is apparent from the above description, a multicolor image forming apparatus according to the present invention can reduce the size of the whole construction and reduce the required installation area, that is, the projection area, and therefore can efficiently utilize the space of an office, etc. Also, according to the present invention, by mounting principal constituent elements of the multicolor image forming apparatus on a sub-frame which is movable with respect to the main frame, the overall maintenance thereof, replacement of parts, etc. can be easily and quickly carried out.

Figure 15:
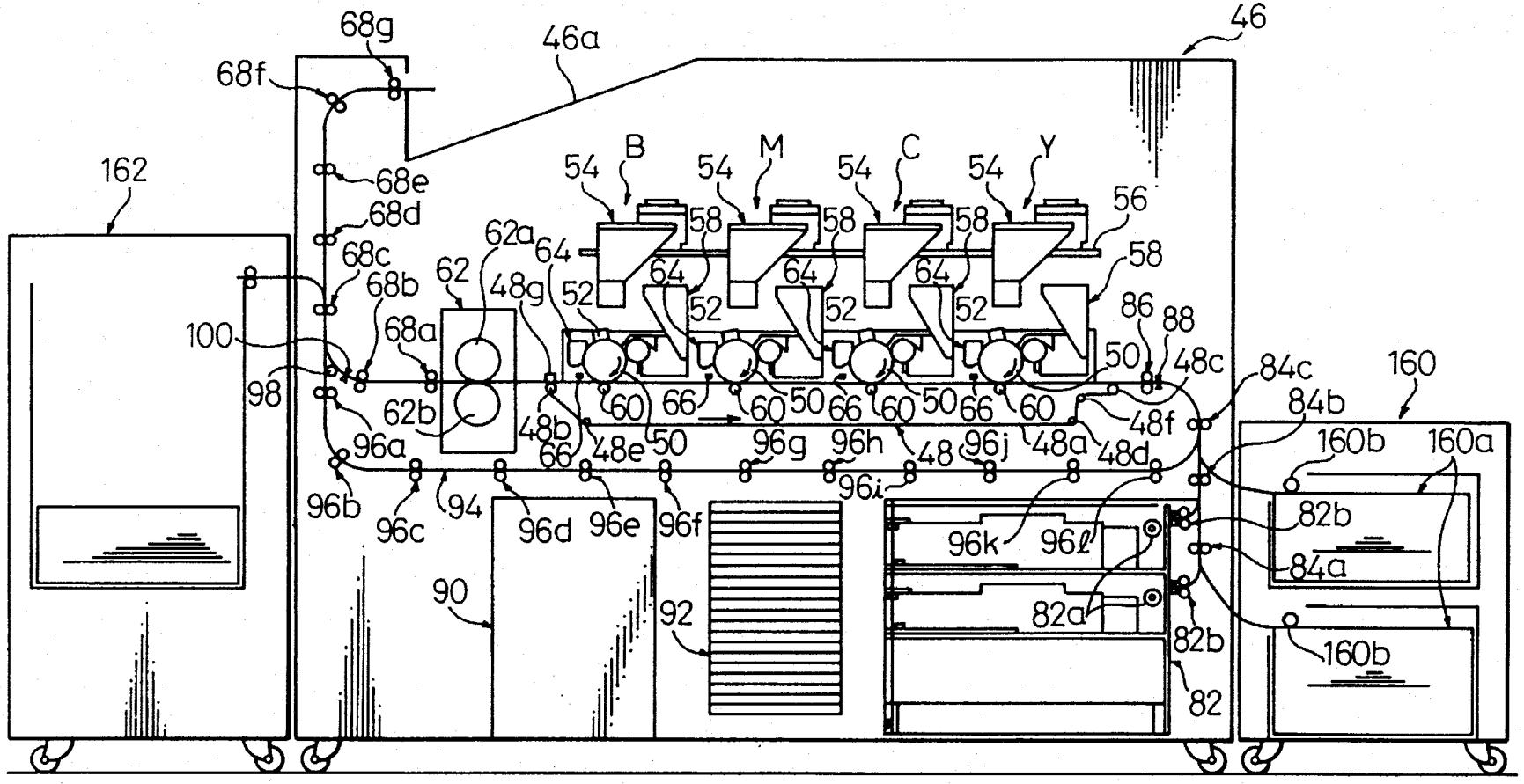
FIG. 15 is a schematic elevation view similar to FIG. 3, showing a modification of the embodiment of the multicolor image forming apparatus shown in FIG. 3.

FIG. 15 shows a modification of the embodiment of the multicolor image forming apparatus shown in FIG. 3. Note, in FIG. 15, the same elements as those shown in FIG. 3 are indicated by the same references. In this modified embodiment, an additional paper feeder unit 160 and an additional paper receiver unit 162 are detachably associated with the apparatus, if necessary, and these units 160 and 162 can be advantageously used to make recordings on a large number of sheets of recording paper.

The additional paper feeder unit 160 includes two paper feed cassettes 160*a* arranged vertically therein and accommodating stacks of paper sheets, respectively, and each of the paper feed cassettes 160*a* is provided with a paper feed out roller 160*b*. The sheet of paper fed from each of the paper feed cassettes 160*a* by the feed out roller 160*b* is introduced into the paper feeding passageway defined by the paper guide roller assemblies 84*a*, 84*b* and 84*c*. Namely, the paper feeding passage way includes two paper guide paths branched therefrom, and these respective paper guide paths continue to paper paths extended from the locations at which the paper feed out rollers 160*b* of the paper feed cassettes 160*a* are positioned, when the additional paper feeder unit 160 is associated with the apparatus. Although not illustrated, of course, the additional paper feeder unit 160 can be operationally connected to the electronic controller unit 92 of the apparatus through an electrical cable including power and signal lines, to controllably drive the paper feeder unit 160.

Figure 16:
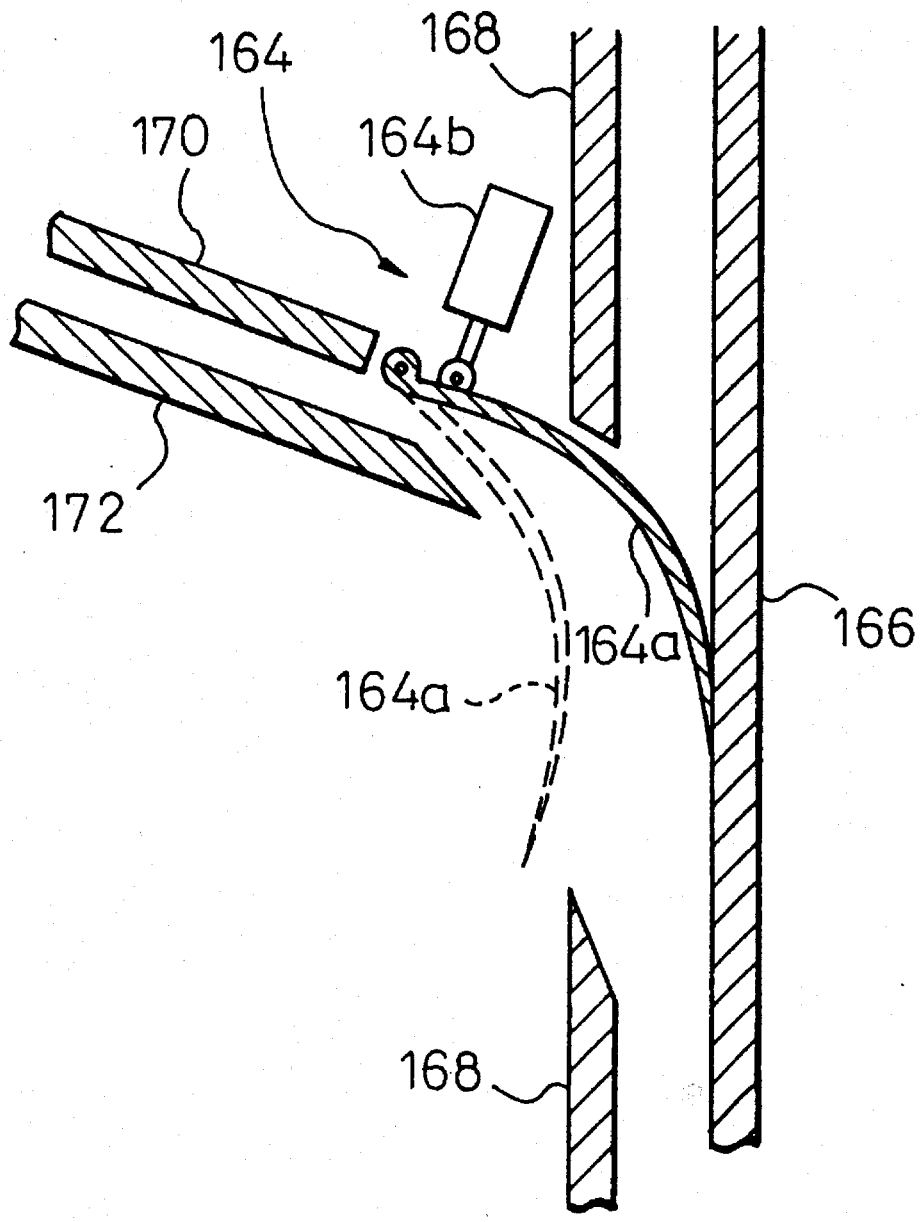
FIG. 16 is a sectional view of a paper switching device incorporated in the multicolor image forming apparatus of FIG. 15.

The additional paper receiver unit 162 includes a paper receiver 162*a* arranged therein, and a pair of rollers 162*b* provided at an upper edge thereof. The paper ejecting passageway defined by the guide roller assemblies 68*a* through 68*g* includes a paper guide path branched therefrom, and this paper guide path continues to a paper guide path extended from the location at which the roller 162*b* is positioned, when the additional paper receiver unit 162 is installed. FIG. 16 shows a paper switching device 164 provided at the location at which the paper guide path is branched from the paper ejecting passageway. In FIG. 16, references 166 and 168 indicate guide plates defining the paper ejecting passageway, and references 170 and 172 indicate guide plates defining the paper guide path branched therefrom. The paper switching device 164 includes a pivotable curved flap 164*a* which comes to form an extended portion of the guide plate 170, and an electromagnetic solenoid 164*b* which pivots the curved flap 164*a* between the solid line position and the broken line position of FIG. 16. Usually, the curved flap 164*a* is at the broken line position and a recorded sheet of paper is ejected onto the paper receiving tray 46*a*. When the electromagnetic solenoid 164*b* is electrically energized, the curved flap 164*a* is at the solid line position so that a recorded sheet of paper is sent to the branched paper guide path defined by the guide plates 170 and 172, whereby the recorded sheet of paper is accommodated in the paper receiver 162*a*. Although not illustrated, of course, the additional paper receiver unit 162 can be operationally connected to the electronic controller unit 92 of the apparatus through an electrical cable including power and signal lines, to control/ably drive the paper receiver unit 162.

Figure 17:
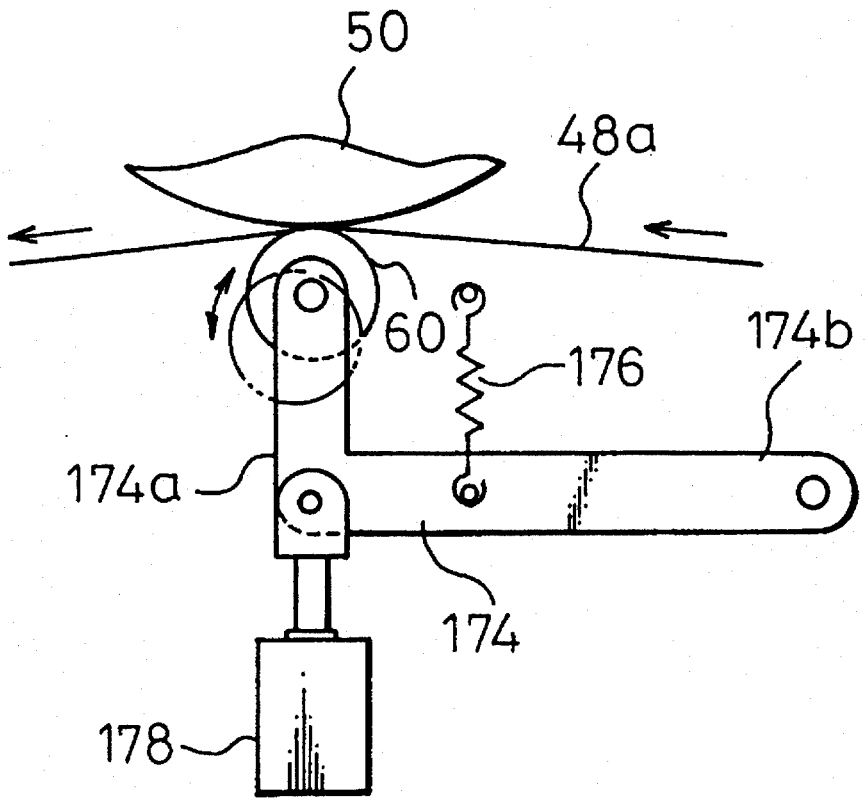
FIG. 17 is a schematic elevation view of a movable transfer roller which may be replaced of transfer rollers provided in the apparatuses shown in FIGS. 3 and 15.

In the above-mentioned embodiment, preferably, the electrically conductive transfer roller 60 is movably incorporated and installed in the endless conveyor belt assembly 48 mounted on the second sub-frame 114, as shown in FIG. 17. Namely, the transfer roller 60 is movably supported by the side plates 127 of the endless conveyor belt assembly 48 through a pair of L-shaped levers 174 (only one visible in FIG. 17) provided between the ends of the transfer roller 60 and the side plates of the endless conveyor belt assembly 48, respectively. In particular, each of the L-shaped levers 174 is pivoted at one end thereof to the corresponding side plate 127, and the other end of the L-shaped lever 174 concerned rotatably supports a corresponding shaft end of the transfer roller 60. A tensile coil spring 176 is provided so as to rotate the L-shaped levers 174 in the clockwise direction in FIG. 17, and an electromagnetic solenoid 178 is provided so as to rotate the L-shaped levers 174 in the counterclockwise direction against the resilient force of the tensile coil spring 176. When the electromagnetic solenoid 178 is electrically de-energized, the transfer roller 60 is resiliently pressed against the surface of the drum 50 due to the resilient force of the tensile coil spring 176, whereby the transfer roller 60 can properly execute the transferring process. When the electromagnetic solenoid 178 is electrically energized, the transfer roller 60 is separated from the drum 50, as shown by a phantom line in FIG. 17.

When one or more of the electrostatic recording units Y, C, M and S is not used in a recording operation of the apparatus, for example, when the electrostatic recording unit Y is not used (i.e., an image to be recorded does not includes a yellow image, the transfer roller 60 of the recording unit Y is separated from the drum 50 by electrically energizing the electromagnetic solenoid 178 thereof. The separation of the transfer roller 60 from the drum 50 can contribute to a prolongation of the service life of the drum 50, because the frictional engagement of the drum 50 with the upper run of the endless belt 48*a* is pointed out as one of the factors of deterioration of the drum 50.

More preferably, in an electrostatic recording unit (Y, C, M and B) not used in a recording operation of the apparatus, the photosensitive drum 50 and the developing device 58 should stopped, because the stoppage of the drum 50 and the developing device 58 can contribute not only to a prolongation of the service life of the drum 50 but also to a prevention of a premature deterioration of the magnetic carrier component of the two-component developer held in the container 70. Note, as well known, the magnetic carrier component of the two-component developer is gradually deteriorated due to the agitating action caused by the agitator 72.

Figure 18A:
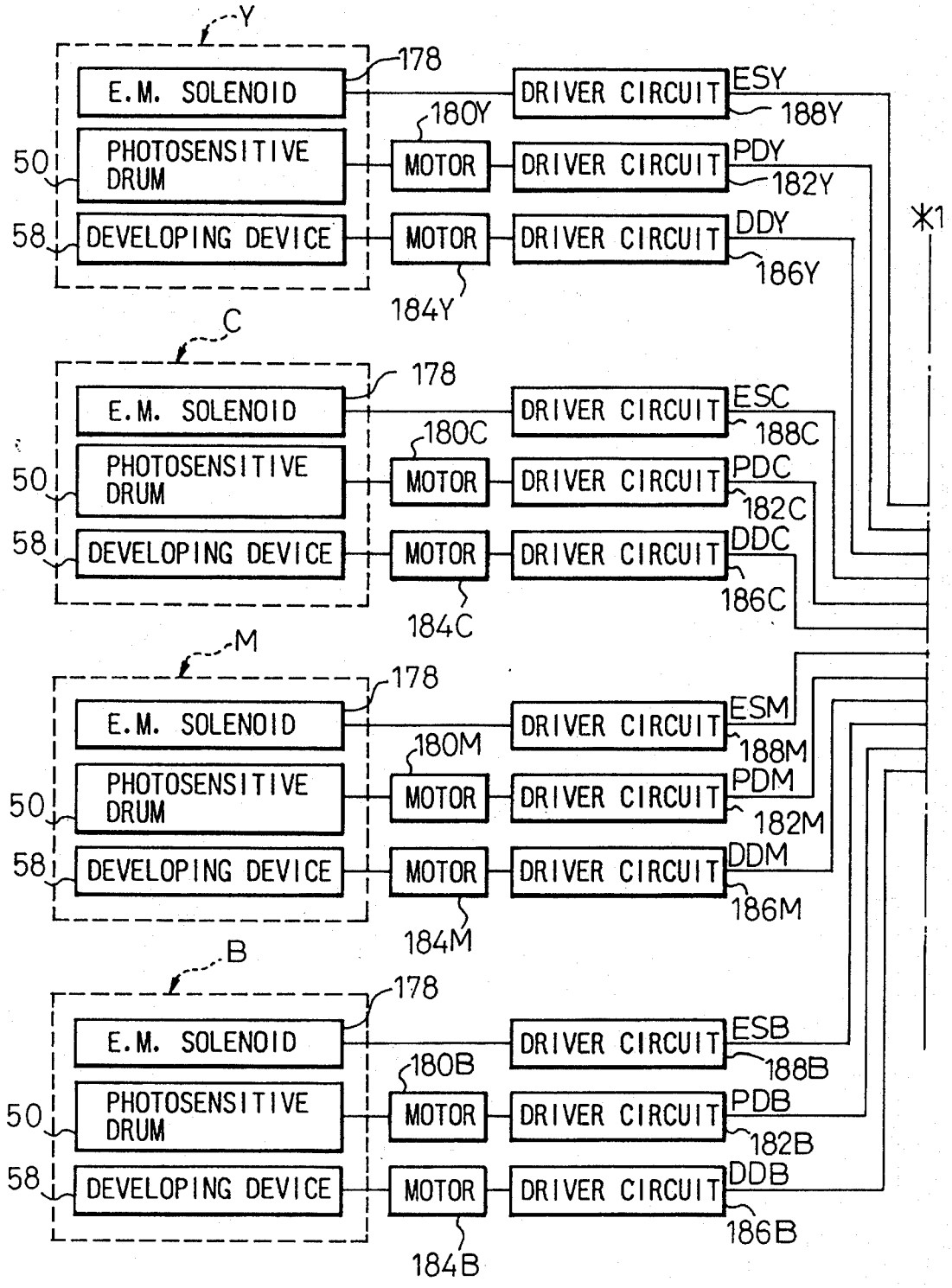
FIGS. 18A and 18B are a block diagram of a control system for controlling the electrostatic recording units provided in the apparatuses shown in FIGS. 3 and 15.
Figure 18B:
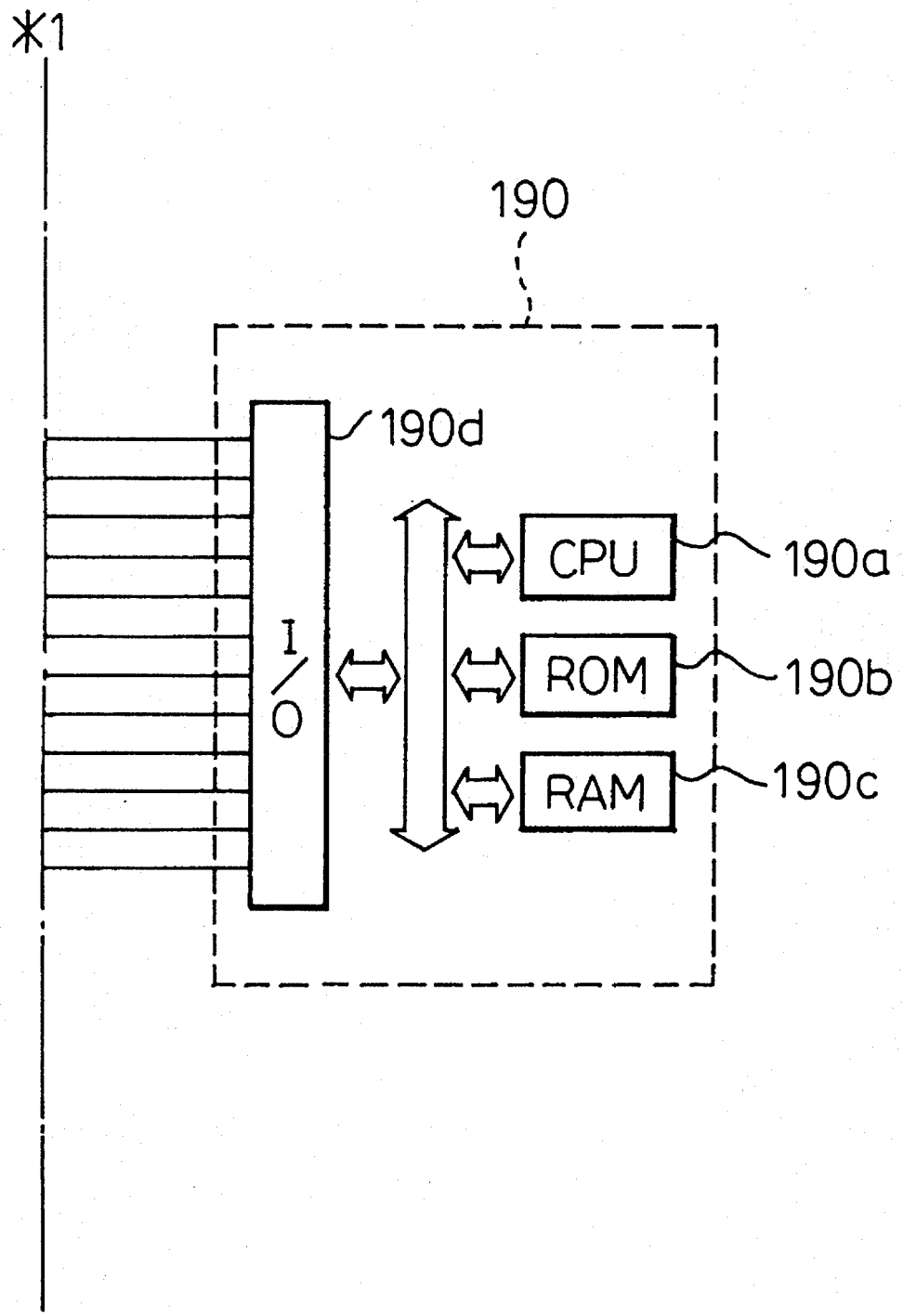

FIGS. 18A and 18B show a control system for controlling the electrostatic recording units Y, C, M and B, and the control system is constituted such that one or more of the recording units Y, C, M and B which is not used in a recording operation of the apparatus can be stopped. As shown in FIGS. 18A and 18B, the respective drums 50 of the recording units Y, C, M and B are rotationally driven by suitable electric motors 180Y, 180C, 180M and 180B (such as stepping motors, servo motors, or the like), which are energized by driver circuits 182Y, 182C, 182M and 182B, respectively. Also, the respective developing devices 58 of the recording units Y, C, M and B are driven by suitable motors 184Y, 184C, 184M and 184B (such as stepping motors, servo motors, or the like), which are energized by driver circuits 186Y, 186C, 186M and 186B, respectively. Further, the respective electromagnetic solenoids 178 of the recording units Y, C, M and B are driven by driver circuits 188Y, 188C, 188M and 188B. The respective driver circuits 182Y, 182C, 182M and 182B; 186Y, 186C, 186M and 186B; and 188Y, 188C, 188M and 188B are connected to a control circuit 190 so as to receive switching signals PDY, PDC, PDM and PDB; DDY, DDC, DDM and DDB; and ESY, ESC, ESM and ESB output therefrom. The control circuit 190 may be constructed by a microcomputer comprising a central processing unit (CPU) 190*a*, a read only memory (ROM) 190*b* for storing routines, constants, etc., a random access memory (RAM) 190*c* for storing temporary data, and an input/output interface (I/O) 190*d*.

When each of the switching signals PDY, PDC, PDM and PDB is changed from a low level "L" to a high level "H" the corresponding driver circuit 182Y, 182C, 182M, 182B is operated to run the corresponding motor 180Y, 180C, 180M, 180B, whereby the corresponding drum 50 is rotationally driven. When each of the switching signals DDY, DDC, DDM and DDB is changed from a low level "D" to a high level "H" the corresponding driver circuit 186Y, 186C, 186M, 186B is operated to run the corresponding motor 184Y, 184C, 184M, 184B, whereby the corresponding developing device 58 is driven. When each of the switching signals ESY, ESC, BSM and ESB is changed from a low level "L" to a high level "H" the corresponding driver circuit 188Y, 188C, 188M, 188B is operated to electrically energize the corresponding electromagnetic solenoid 178.

Figure 19A:
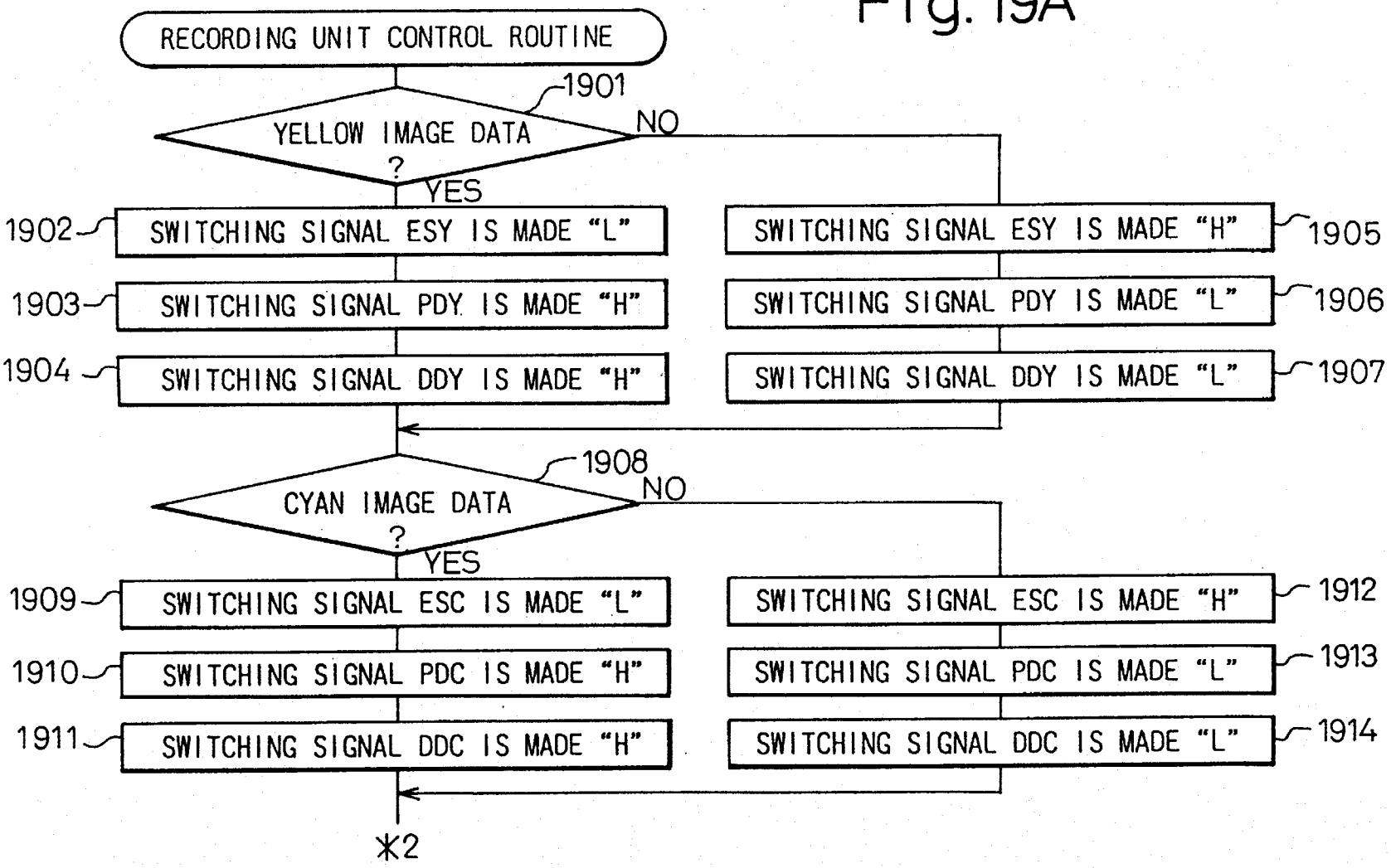
FIGS. 19A and 19B are a flow chart for explaining an operation of the control system shown in FIGS. 18A and 18B.
Figure 19B:
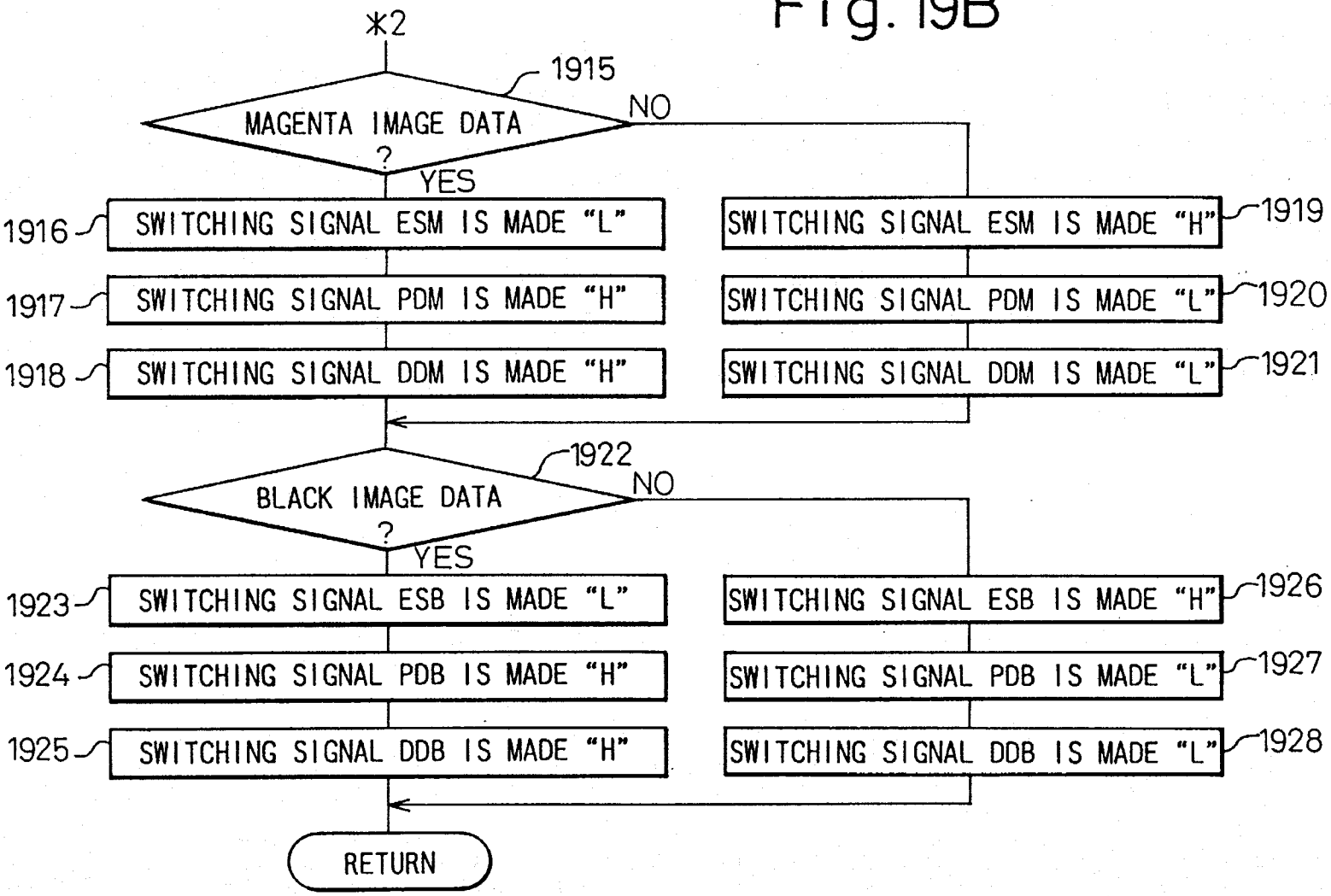

An operation of the control system shown in FIGS. 18A and 18B will be now explained with reference to a recording unit control routine shown in FIGS. 19A and 19B. Note, the recording unit control routine of FIGS. 19A and 19B forms a part of an operation routine of the apparatus, and is executed whenever one page worth of image data to be recorded is prepared.

At step 1901, it is determined whether or not the one page worth of image data includes yellow image data. If yellow image data is included in the one page worth of image data, the routine proceeds to step 1902 at which the switching signal ESY is made "L", so that the transfer roller 60 of the recording unit Y is pressed against the drum 50. Then, at step 1903, the switching signal PDY is made "H", so that the drum 50 of the recording unit Y is rotationally driven. Successively, at step 1904, the switching signal DDY is made "H", so that the developing device 58 of the recording unit Y is driven. Thus, the recording of yellow toner image on a sheet of paper on the basis of the yellow image data is carried out in the recording unit Y.

If no yellow image data is included in the one page worth of image data, the routine proceeds from step 1901 to step 1905 at which the switching signal ESY is made "H", so that the transfer roller 60 of the recording unit Y is separated from the drum 50. Then, at step 1906, the switching signal PDY is made "L", so that the drum 50 of the recording unit Y is stopped. Successively, at step 1907, the switching signal DDY is made "L", so that the developing device 58 of the recording unit Y is stopped. Thus, no recording of yellow toner image on a sheet of paper is carried out in the recording unit Y.

Then, the routine proceeds to step 1908 at which it is determined whether or not the one page worth of image data includes cyan image data. If cyan image data is included in the one page worth of image data, the routine proceeds to step 1909 at which the switching signal ESC is made "L", so that the transfer roller 60 of the recording unit C is pressed against the drum 50. Then, at step 1910, the switching signal PDC is made "H", so that the drum 50 of the recording unit C is rotationally driven. Successively, at step 1911, the switching signal DDC is made "H", so that the developing device 58 of the recording unit C is driven. Thus, the recording of cyan toner image on a sheet of paper on the basis of the cyan image data can be carried out in the recording unit C.

If no cyan image data is included in the one page worth of image data, the routine proceeds from step 1908 to step 1912 at which the switching signal ESC is made "H", so that the transfer roller 60 of the recording unit C is separated from the drum 50. Then, at step 1913, the switching signal PDC is made "L", so that the drum 50 of the recording unit C is stopped. Successively, at step 1914, the switching signal DDC is made "L", so that the developing device 58 of the recording unit C is stopped. Thus, no recording of cyan toner image on a sheet of paper is carried out in the recording unit C.

Then, the routine proceeds to step 1915 at which it is determined whether or not the one page worth of image data includes magenta image data. If magenta image data is included in the one page worth of image data, the routine proceeds to step 1916 at which the switching signal ESM is made "L", so that the transfer roller 60 of the recording unit M is pressed against the drum 50. Then, at step 1917, the switching signal PDM is made "H", so that the drum 50 of the recording unit M is rotationally driven, Successively, at step 1918, the switching signal DDM is made "H", so that the developing device 58 of the recording unit M is driven. Thus, the recording of magenta toner image on a sheet of paper on the basis of the magenta image data can be carried out in the recording unit M.

If no magenta image data is included in the one page worth of image data, the routine proceeds from step 1915 to step 1919 at which the switching signal ESM is made "H", so that the transfer roller 60 of the recording unit M is separated from the drum 50. Then, at step 1920, the switching signal PDM is made "L", so that the drum 50 of the recording unit M is stopped. Successively, at step 1921, the switching signal DDM is made "L", so that the developing device 58 of the recording unit M is stopped. Thus, no recording of magenta toner image on a sheet of paper is carried out in the recording unit M.

Then, the routine proceeds to step 1922 at which it is determined whether or not the one page worth of image data includes black image data. If black image data is included in the one page worth of image data, the routine proceeds to step 1923 at which the switching signal ESB is made "n", so that the transfer roller 60 of the recording unit B is pressed against the drum 50. Then, at step 1924, the switching signal PDB is made "H", so that the drum 50 of the recording unit B is rotationally driven. Successively, at step 1925, the switching signal DDB is made "H", so that the developing device 58 of the recording unit B is driven. Thus, the recording of black toner image on a sheet of paper on the basis of the black image data can be carried out in the recording unit S.

If no black image data is included in the one page worth of image data, the routine proceeds from step 1922 to step 1926 at which the switching signal ESB is made "H", so that the transfer roller 60 of the recording unit B is separated from the drum 50. Then, at step 1927, the switching signal PDB is made "L", so that the drum 50 of the recording unit B is stopped. Successively, at step 1928, the switching signal DDB is made "L", so that the developing device 58 of the recording unit C is stopped. Thus, no recording of magenta toner image on a sheet of paper is carried out in the recording unit B.

Figure 20A:
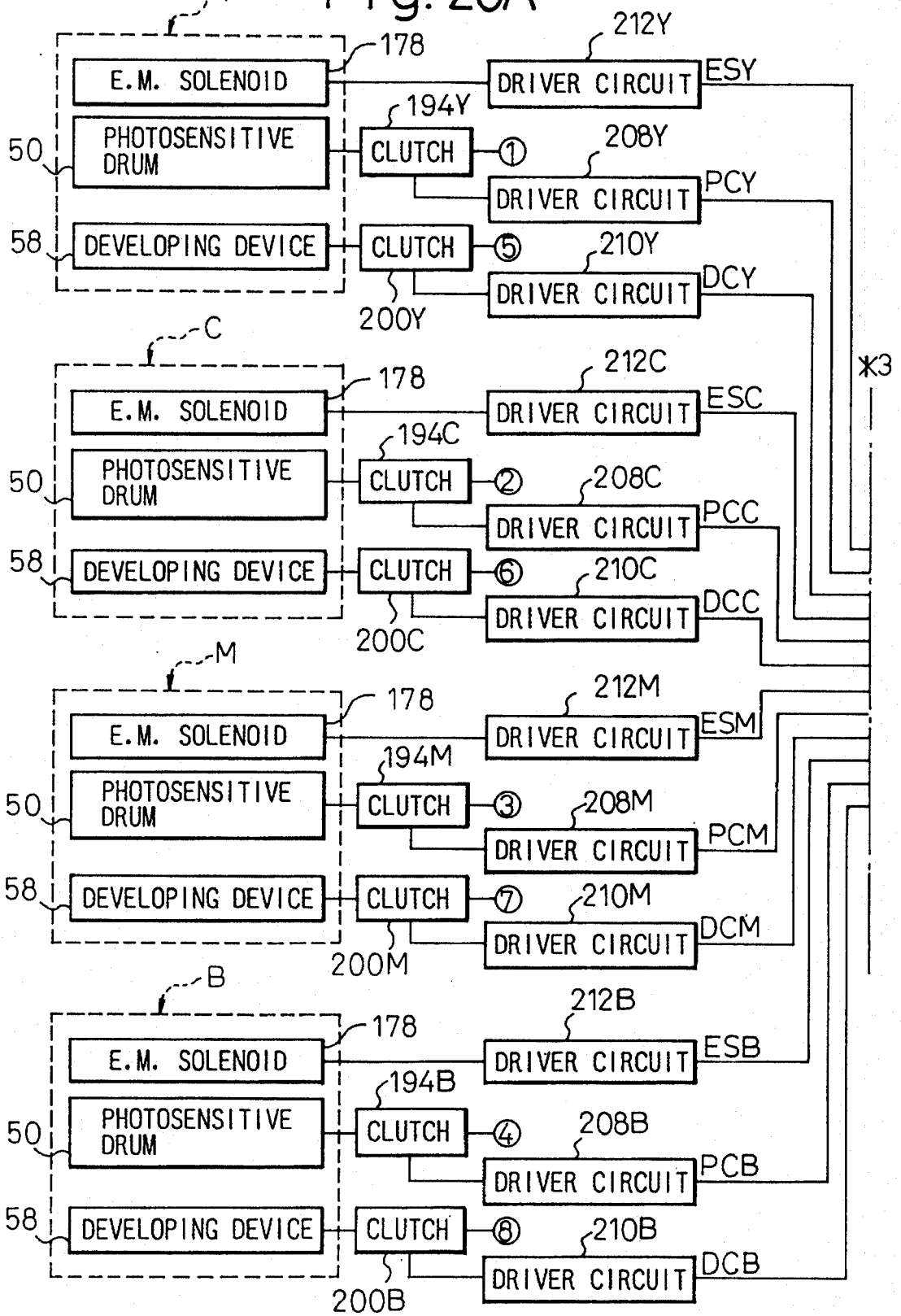
FIGS. 20A and 20B are a block diagram of another control system for controlling the electrostatic recording units provided in the apparatuses shown in FIGS. 3 and 15.
Figure 20B:
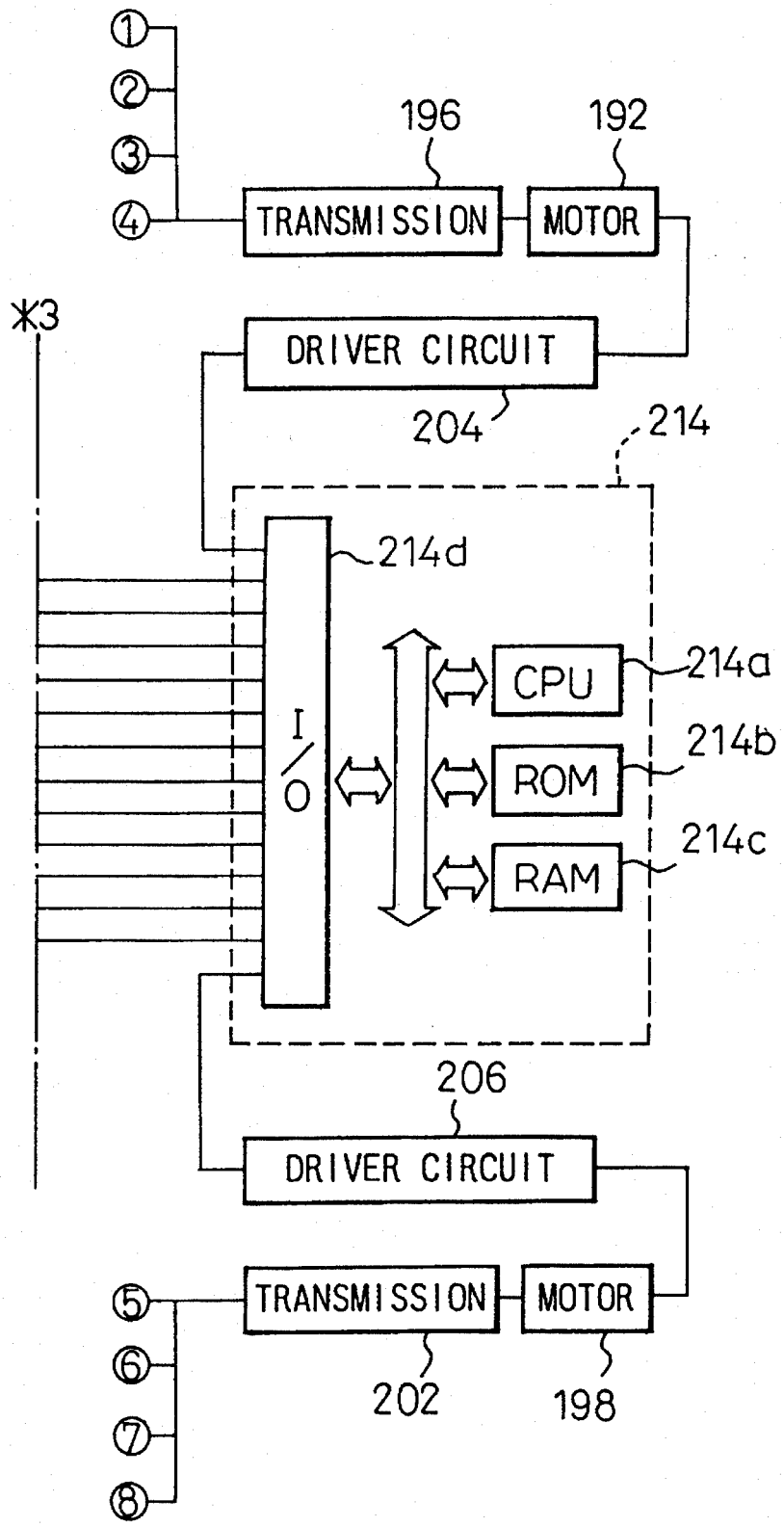

FIGS. 20A and 20B shows another control system for controlling the electrostatic recording units Y, C, M and B, and this control system is also constituted such that one or more of the recording units Y, C, M and B which is not used in a recording operation of the apparatus can be stopped. As shown in FIGS. 20A and 20B, the respective drums 50 of the recording units Y, C, M and B are joined to a common electric motor 192 such as a stepping motor, a servo motor or the like through clutches 194Y, 194C, 194M and 194B and a suitable transmission 196 such as an endless drive belt. Also, the respective developing devices 58 of the recording units Y, C, M and B are joined to a common electric motor 198 such as a stepping motor, a servo motor or the like through clutches 200Y, 200C, 200M and 200B and a suitable transmission 202 such as an endless drive bait. The respective motors 192 and 198 are driven by driver circuits 204 and 206, respectively. The respective clutches 194Y, 194C, 194M and 194B are operated by driver circuits 208Y, 208C, 208M, and 208B, and the respective clutches 200Y, 200C, 200M and 200B are operated by driver circuits 210Y, 210C, 210M and 210B. The respective electromagnetic solenoids 178 of the recording units Y, C, M and B are driven by driver circuits 212Y, 212C, 212M and 212B. The driver circuits 204 and 206 are connected to a control circuit 214 so as to receive switching signals therefrom, respectively. Also, the respective driver circuits 208Y, 208C, 208M and 208B; 210Y, 210C, 210M and 210B; and 212Y, 212C, 212M and 212B are connected to the control circuit 214 so as to receive switching signals PCY, PCC, PCM and PCB; DCY, DCC, DCM and DCB; and ESY, ESC, ESM and ESB output therefrom. The control circuit 214 may be constructed by a microcomputer comprising a central processing unit (CPU) 214*a*, a read only memory (ROM) 214*b* for storing routines, constants, etc., a random access memory (RAM) 214*c* for storing temporary data, and an input/output interface (I/O) 214*d*.

When the switching signal output from the control circuit 214 to each of the driver circuits 204 and 206 is changed from a low level "L" to a high level "H" the corresponding motor 192, 198 is run. When each of the switching signals PCY, PCC, PCM and PCB is changed from a low level "L" to a high level "H", the corresponding driver circuit 208Y, 208C, 208M, 208B is operated to make the corresponding clutch 194Y, 194C, 194M, 194B to be ON, whereby the corresponding drum 50 is rotationally driven. When each of the switching signals DCY, DCC, DCM and DCB is changed from a low level "n" to a high level "H", the corresponding driver circuit 210Y, 210C, 210M, 210B is operated to make the corresponding clutch 200Y, 200C, 200M, 200B to be ON, whereby the corresponding developing device 58 is driven. When each of the switching signals ESY, ESC, ESM and ESB is changed from a low level "L" to a high level "H", the corresponding driver circuit 212Y, 212C, 212M, 212B is operated to electrically energize the corresponding electromagnetic solenoid 178.

Figure 21A:
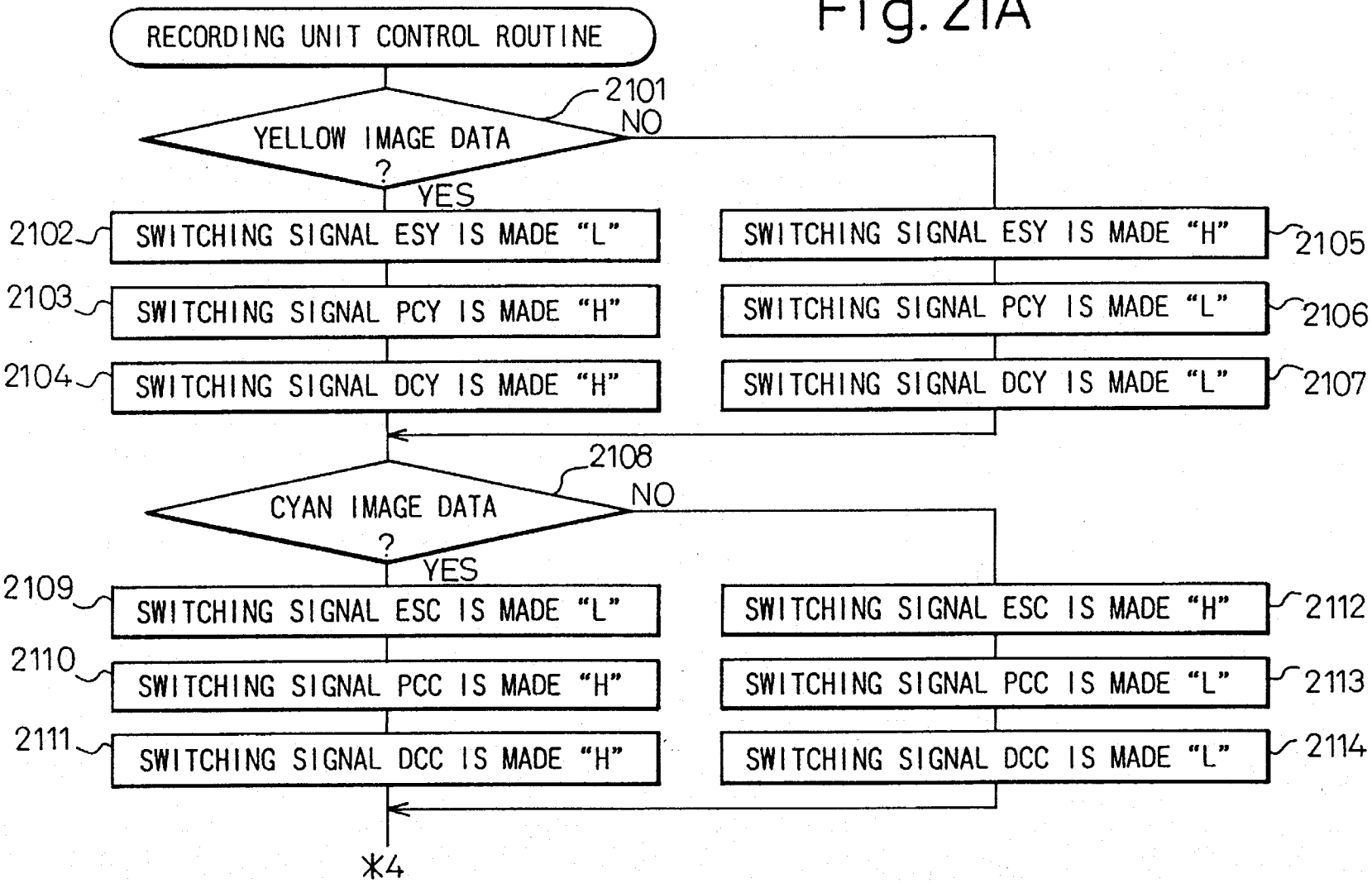
FIGS. 21A and 21B are a flow chart for explaining an operation of the control system shown in FIGS. 20A and 20B.
Figure 21B:
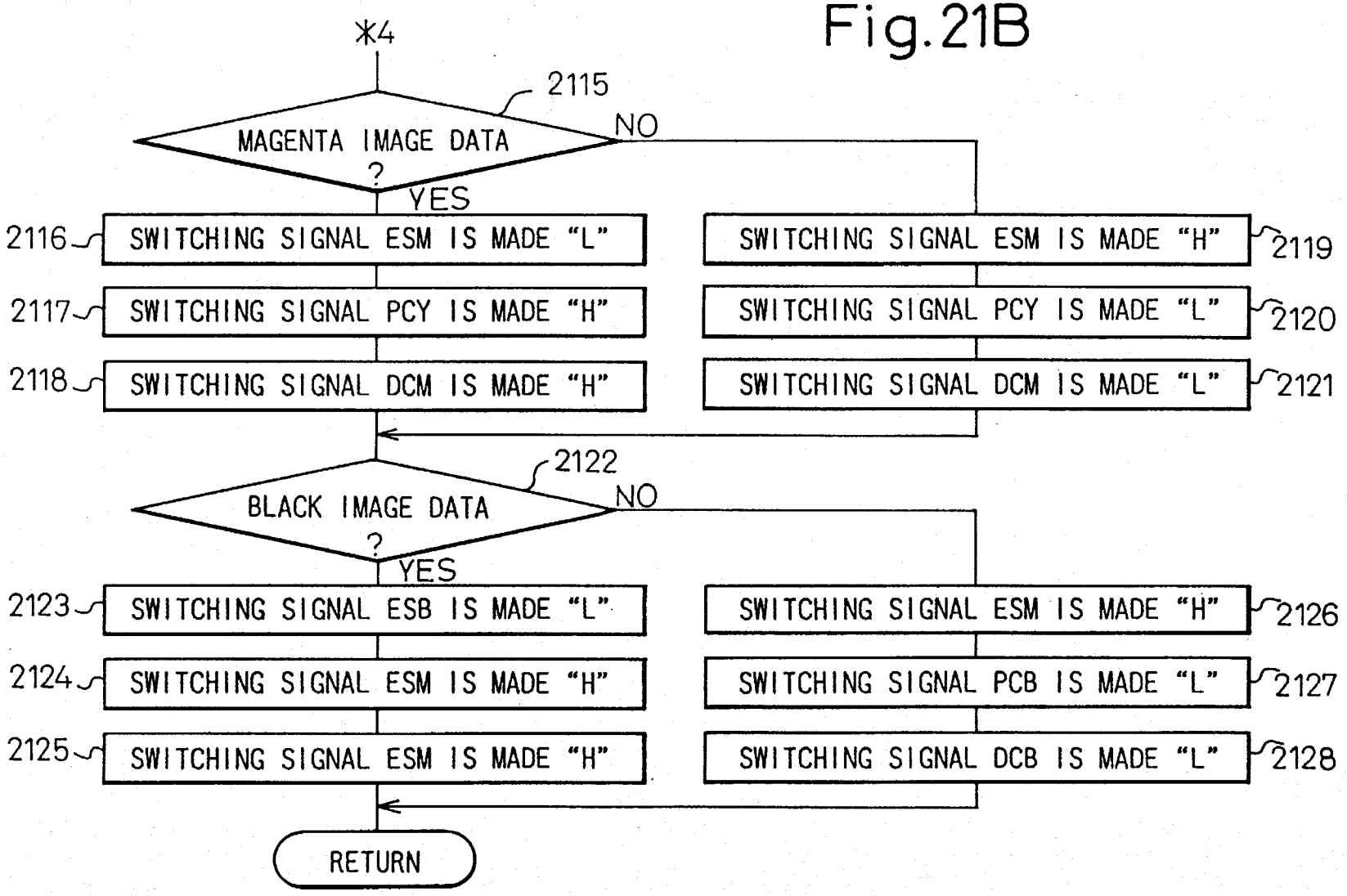

An operation of the control system shown in FIGS. 20A and 20B will be now explained with reference to a recording unit control routine shown in FIGS. 21A and 21B. Note, the recording unit control routine of FIGS. 20A and 20B forms a part of an operation routine of the apparatus, and is executed whenever one page worth of image data to be recorded is prepared.

At step 2101, it is determined whether or not the one page worth of image data includes yellow image data. If yellow image data is included in the one page worth of image data, the routine proceeds to step 2102 at which the switching signal ESY is made "L", so that the transfer roller 60 of the recording unit Y is pressed against the drum 50. Then, at step 2103, the switching signal PCY is made "H", so that the drum 50 of the recording unit Y is rotationally driven. Successively, at step 2104, the switching signal DCY is made "H", so that the developing device 58 of the recording unit Y is driven. Thus, the recording of yellow toner image on a sheet of paper on the basis of the yellow image data is carried out in the recording unit Y.

If no yellow image data is included in the one page worth of image data, the routine proceeds from step 2101 to step 2105 at which the switching signal ESY is made "H", so that the transfer roller 60 of the recording unit Y is separated from the drum 50. Then, at step 2106, the switching signal PCY is made "L", so that the drum 50 of the recording unit Y is stopped. Successively, at step 2107, the switching signal DCY is made "L", so that the developing device 58 of the recording unit Y is stopped. Thus, no recording of yellow toner image on a sheet of paper is carried out in the recording unit Y.

Then, the routine proceeds to step 2108 at which it is determined whether or not the one page worth of image data includes cyan image data. If cyan image data is included in the one page worth of image data, the routine proceeds to step 2109 at which the switching signal ZSC is made "L", so that the transfer roller 60 of the recording unit C is pressed against the drum 50. Then, at step 2110, the switching signal PCC is made "H", so that the drum 50 of the recording unit C is rotationally driven., Successively, at step 2111, the switching signal DCC is made "H", so that the developing device 58 of the recording unit C is driven. Thus, the recording of cyan toner image on a sheet of paper on the basis of the cyan image data can be carried out in the recording unit C.

If no cyan image data is included in the one page worth of image data, the routine proceeds from step 2108 to step 2112 at which the switching signal ESC is made "H", so that the transfer roller 60 of the recording unit C is separated from the drum 50. Then, at step 2113, the switching signal PCC is made "L", so that the drum 50 of the recording unit C is stopped. Successively, at step 2114, the switching signal DCC is made "L", so that the developing device 58 of the recording unit C is stopped. Thus, no recording of cyan toner image on a sheet of paper is carried out in the recording unit C.

Then, the routine proceeds to step 2115 at which it is determined whether or not the one page worth of image data includes magenta image data. If magenta image data is included in the one page worth of image data, the routine proceeds to step 2116 at which the switching signal ESM is made "L", so that the transfer roller 60 of the recording unit M is pressed against the drum 50. Then, at step 2117, the switching signal PCM is made "H", so that the drum 50 of the recording unit M is rotationally driven. Successively, at step 2118, the switching signal DCM is made "H", so that the developing device 58 of the recording unit M is driven. Thus, the recording of magenta toner image on a sheet of paper on the basis of the magenta image data can be carried out in the recording unit M.

If no magenta image data is included in the one page worth of image data, the routine proceeds from step 2115 to step 2119 at which the switching signal ESM is made "H", so that the transfer roller 60 of the recording unit M is separated from the drum 50. Then, at step 2120, the switching signal PCM is made "L", so that the drum 50 of the recording unit M is stopped. Successively, at step 2121, the switching signal DCM is made "L", so that the developing device 58 of the recording unit C is stopped. Thus, no recording of magenta toner image on a sheet of paper is carried out in the recording unit M.

Then, the routine proceeds to step 2122 at which it is determined whether or not the one page worth of image data includes black image data. If black image data is included in the one page worth of image data, the routine proceeds to step 2123 at which the switching signal ESB is made "L" so that the transfer roller 60 of the recording unit B is pressed against the drum 50. Then, at step 2124, the switching signal PCB is made "H", so that the drum 50 of the recording unit B is rotationally driven. Successively, at step 2125, the switching signal DCB is made "H", so that the developing device 58 of the recording unit B is driven. Thus, the recording of black toner image on a sheet of paper on the basis of the black image data can be carried out in the recording unit B.

If no black image data is included in the one page worth of image data, the routine proceeds from step 2122 to step 2126 at which the switching signal ESB is made "M", so that the transfer roller 60 of the recording unit B is separated from the drum 50. Then, at step 2127, the switching signal PCB is made "L", so that the drum 50 of the recording unit B is stopped. Successively, at step 2128, the switching signal DCB is made "L", so that the developing device 58 of the recording unit C is stopped. Thus, no recording of magenta toner image on a sheet of paper is carried out in the recording unit B.

Finally, it will be understood by those skilled in the art that the foregoing description is of embodiments of the disclosed apparatus, and that various changes and modifications may be made to the present invention without departing from the spirit and scope thereof.

We claim:

1. A color image forming apparatus comprising:

a recording medium moving means for providing a path of moving a recording medium, said recording medium moving means having a recording medium introduction side and a recording medium ejection side;

a recording medium feeding means arranged beneath the recording medium introduction side of said recording medium moving means;

a first recording medium guiding means for sending the recording medium fed form said recording medium feeding means upwardly and for guiding the same to the recording medium introduction side of said recording medium moving means;

at least two electrostatic recording units which are arranged in series along the path for moving the recording medium so as to record electrically charged toner images by different colors on the recording medium sent along the path for moving the recording medium, each of said electrostatic recording units including an electrostatic latent image carrying body;

a fixing means which is arranged on the recording medium ejection side of said recording medium moving means for fixing the charged toner image on the recording medium carrying said electrically charged toner image;

a second recording medium guiding means for guiding upward the recording medium passed through said fixing means;

a recording medium receiving means which is arranged above said fixing means for accommodating the recording medium sent by said second recording medium guiding means;

a main frame, and a first sub-frame which is movable between a pushed-in position in said main frame and a pulled-out position drawn out of said main frame;

said electrostatic latent image carrying body being mounted on said first sub-frame; and said electrostatic latent image carrying body having a driven coupling provided at one shaft end thereof, and said driven coupling being engaged with a drive coupling provided in said main frame when said first sub-frame is moved to the pushed-in position thereof.

2. A color image forming apparatus as set forth in claim 1, wherein a power source means and a control means of said apparatus are provided beneath said recording medium moving means.

3. A color image forming apparatus as set forth in claim 1, further comprising a recording medium bypass passageway means for returning the recording medium from said second recording medium guiding means to said first recording medium guiding means so as to perform a two-sided recording on the recording medium, said recording medium bypass passageway means being extended just below said recording medium moving means and above an upper side of said recording medium feeding means.

4. A color image forming apparatus as set forth in claim 1, wherein each of said electrostatic recording units includes said electrostatic latent image carrying body; an electrically charging means for giving an electrically charged area to this electrostatic latent image carrying body; an optical writing means for optically writing the electrostatic latent image in the charged area of said electrostatic latent image carrying body; a developing means for developing the electrostatic latent image on said electrostatic latent image carrying body as a charged toner image; a transfer means for electrostatically transferring the charged toner image developed by said developing means from said electrostatic latent image carrying body to the recording medium to be moved by said recording medium moving means; and a cleaning means for cleaning a residual toner of said electrostatic latent image carrying body therefrom.

5. A color image forming apparatus as set forth in claim 4, wherein said developing means is detachably mounted on said first sub-frame; and said electrostatic latent image carrying body, said electrically charging means, and said cleaning means are further detachably mounted thereon as a unit or individually on said first sub-frame.

6. A color image forming apparatus as set forth in claim 5, further comprising a second sub-frame which is movable between a pushed-in position in said main frame and a pulled-out position drawn out of said main frame, and which is arranged beneath said first sub-frame, said recording medium moving means being mounted on said second sub-frame.

7. A color image forming apparatus as set forth in claim 6, wherein said second sub-frame has a positioning coupling provided therein, said positioning coupling is engaged with the other shaft end of said electrostatic latent image carrying body when said second sub-frame is moved to the pushed-in position thereof.

8. A color image forming apparatus as set forth in claims 6, wherein said transfer means is installed in said recording medium moving means detachably mounted on said second sub-frame.

9. A color image forming apparatus as set forth in claims 6, wherein said recording medium moving means includes a driven roller and a drive roller which are respectively provided on the recording medium introduction side and the recording medium ejection side thereof, and an endless belt engaged with said rollers, the two end portions of both shafts of said driven roller and said drive roller being supported detachably by said second sub-frame.

10. A color image forming apparatus as set forth in claim 9, wherein the drive shaft of said drive roller is detachably supported by said second sub-frame via a bearing provided on the two end portions thereof; and wherein said drive shaft has a driven coupling provided at one end portion thereof, and said driven coupling is engaged with the drive coupling provided in said main frame when said second sub-frame is moved to the pushed-in position thereof.

11. A color image forming apparatus as set forth in claims 6, further comprising a recording medium bypass passageway means provided between said first recording medium guiding means and said second recording medium guiding means so that a two-sided recording can be made on the recording medium.

12. A color image forming apparatus as set forth in claim 11, wherein said recording medium bypass passageway means has a plurality of recording medium guide roller assemblies each of which forms a part of said recording medium bypass passageway means, each of said recording medium guide roller assemblies includes a pair of shaft elements, and roller elements mounted on each of said shaft elements, one of said of shaft elements being rotatably supported by a first guide plate attached to a bottom portion of said second sub-frame, the other shaft element being rotatably supported by a second guide plate pivotably attached to said first guide plate, said second guide plate being locked to said first guide plate so as to maintain a position where it is parallel to said first guide plate.

13. A color image forming apparatus as set forth in claims 6, wherein said fixing means is mounted on said second sub-frame.

14. A color image forming apparatus as set forth in claim 13, wherein said liming means comprises a heat fixing device, and wherein a cooling means for cooling said heat fixing device is provided in said main frame so as to be above said heat fixing device when said second sub-frame is moved to the pushed-in position.

15. A color image forming apparatus as set forth in claims 1, further comprising an additional recording medium feeding means optionally associated with said first recording medium guiding means for feeding a recording medium from said additional recording medium feeding means to said first recording medium guiding means, and an additional recording medium receiving means optionally associated with said second recording medium guiding means for accommodating the recording medium sent by said second recording medium guiding means.

16. A color image forming apparatus as set forth in claim 15, wherein said second recording medium guiding means has a recording medium guide path branched therefrom, and a recording medium switching means provided at a location at which said recording medium guide path is branched from said second recording medium guiding means.

17. A color image forming apparatus comprising:

a recording medium moving means for providing a path for moving a recording medium, said recording medium moving means having a recording medium introduction side and a recording medium ejection side;

a recording medium feeding means arranged beneath the recording medium introduction side of said recording medium moving means;

a first recording medium guiding means for sending the recording medium fed from said recording medium feeding means upwardly and for guiding the same to the recording medium introduction side of said recording medium moving means;

at least two electrostatic recording units which are arranged in series along the path for moving the recording medium so as to record electrically charged toner images by different colors on the recording medium sent along the path for moving the recording medium;

a fixing means which is arranged on the recording medium ejection side of said recording medium moving means for fixing the charged toner image on the recording medium carrying said electrically charged toner image;

a main frame, and a first sub-frame which is movable between a pushed-in position in said main frame and a pulled-out position drawn out of said main frame, said developing means being detachably mounted on said first sub-frame; said electrostatic latent image carrying body, said electrically charging means, and said cleaning means being further detachably mounted on said first sub-frame as a unit or individually;

a second sub-frame which is movable between a pushed-in position in said main frame and a pulled-out position drawn out of said main frame, and which is arranged beneath said first sub-frame, said recording medium moving means being mounted on said second sub-frame; and said second sub-frame having a positioning coupling provided therein, said positioning coupling is engaged with the other shaft end of said electrostatic latent image carrying body when said second sub-frame is moved to the pushed-in position thereof.

18. A color image forming apparatus as set forth in claim 17, wherein said electrostatic latent image carrying body has a driven coupling provided at one shaft end thereof, and said driven coupling is engaged with a drive coupling provided in said main frame when said first sub-frame is moved to the pushed-in position thereof.

19. A color image forming apparatus as set forth in claim 17, wherein said recording medium moving means includes a driven roller and a drive roller which are respectively provided on the recording medium introduction side and the recording medium ejection side thereof, and an endless belt engaged with said rollers, the two end portions of both shafts of said driven roller and said drive roller being supported detachably by said second sub-frame.

20. A color image forming apparatus as set forth in claim 19, wherein the drive shaft of said drive roller is detachably supported by said second sub-frame via a bearing provided on the two end portions thereof; and wherein said drive shaft has a driven coupling provided at one end portion thereof, and said driven coupling is engaged with the drive coupling provided in said main frame when said second sub-frame is moved to the pushed-in position thereof.

21. A color image forming apparatus as set forth in claim 17, wherein said fixing means is mounted on said second sub-frame.

22. A color image forming apparatus as set forth in claim 21, wherein said fixing means comprises a heat fixing device, and wherein a cooling means for cooling said heat fixing device is provided in said main frame so as to be above said heat fixing device when said second sub-frame is moved to the pushed-in position.

23. A color image forming apparatus as set forth in claim 17, further comprising an additional recording medium feeding means optionally associated with said first recording medium guiding means for feeding a recording medium from said additional recording medium feeding means to said first recording medium guiding means, and an additional recording medium receiving means optionally associated with said second recording medium guiding means for accommodating the recording medium sent by said second recording medium guiding means.

24. A color image forming apparatus as set forth in claim 23, wherein said second recording medium guiding means has a recording medium guide path branched therefrom, and a recording medium switching means provided at a location at which said recording medium guide path is branched from said second recording medium guiding means.

25. A color image forming apparatus comprising:

a recording medium moving means for providing a path for moving a recording medium;

a first electrostatic recording unit arranged on said path for moving the recording medium so as to record an electrically charged toner image on the recording medium on the basis of a first color image data, said first electrostatic recording unit including an electrostatic latent image carrying body on which an electrostatic latent image is formed, and a developing means for developing the electrostatic latent image on said electrostatic latent image carrying body with a first color toner as a charged toner image;

a second electrostatic recording unit arranged and aligned with said first electrostatic recording unit along said path for moving the recording medium so as to record an electrically charged toner image on the recording medium on the basis of a second color image data, said second electrostatic recording unit including an electrostatic latent image carrying body on which an electrostatic latent image is formed, and a developing means for developing the electrostatic latent image on said electrostatic latent image carrying body with a second color toner as a charged toner image;

a first determination means for determinating whether or not the first color image data is included in a whole image data to be recorded;

a first stopping means for stopping the electrostatic latent image carrying body and the developing means of said first electrostatic recording unit when it is determined by said first determination means that the first color image data is not included in the whole image data to be recorded;

a second determination means for determinating whether or not the second color image data is included in the whole image data to be recorded; and a second stopping means for stopping the electrostatic latent image carrying body and the developing means of said first electrostatic recording unit when it is determined by said second determination means that the second color image data is not included in the whole image data to be recorded.

26. A color image forming apparatus as set forth in claim 25, wherein said recording medium moving means includes an endless recording medium conveyor belt an upper run of which provides said path for moving the recording medium; wherein there is a first separation means for separating the upper run of said endless recording medium conveyor belt from the electrostatic latent image carrying body of said first electrostatic recording unit when stopping the same by said first stopping means; and wherein there is a second separation means for separating the upper run of said endless recording medium conveyor belt from the electrostatic latent image carrying body of said second electrostatic recording unit when stopping the same by said second stopping means.

* * * * *